US008310410B2

(12) United States Patent
Shingai et al.

(10) Patent No.: US 8,310,410 B2
(45) Date of Patent: Nov. 13, 2012

(54) DISPLAY DEVICE HAVING DISPLAY ELEMENT OF SIMPLE MATRIX TYPE, DRIVING METHOD OF THE SAME AND SIMPLE MATRIX DRIVER

(75) Inventors: Tomohisa Shingai, Kawasaki (JP); Masaki Nose, Kawasaki (JP); Yuji Ueno, Inagi (JP); Hiroyuki Matsuo, Inagi (JP)

(73) Assignees: Fujitsu Frontech Limited, Inagi-shi, Tokyo (JP); Fujitsu Limited, Kawasaki (JP)

( * ) Notice: Subject to any disclaimer, the term of this patent is extended or adjusted under 35 U.S.C. 154(b) by 319 days.

(21) Appl. No.: 12/758,345

(22) Filed: Apr. 12, 2010

(65) Prior Publication Data

US 2010/0194736 A1 Aug. 5, 2010

Related U.S. Application Data

(63) Continuation of application No. PCT/JP2007/070098, filed on Oct. 15, 2007.

(51) Int. Cl.
*G09G 3/20* (2006.01)

(52) U.S. Cl. ..... 345/55

(58) Field of Classification Search ..... 345/87–102, 345/204, 209, 210, 211, 696, 55
See application file for complete search history.

(56) References Cited

U.S. PATENT DOCUMENTS 5,013,137 A 5/1991 Tsuboyama et al.
2001/0040542 A1* 11/2001 Harada et al. ..... 345/87
2006/0238443 A1* 10/2006 Derichs ..... 345/55
2008/0024472 A1 1/2008 Nose et al.
2008/0284712 A1* 11/2008 Muto et al. ..... 345/101

FOREIGN PATENT DOCUMENTS

CN 1802685 A 7/2006
EP 1662469 A1 5/2006
JP 62-134691 A 6/1987
JP 63-266488 A 11/1988
JP 2-211497 A 8/1990

(Continued)

OTHER PUBLICATIONS

Korean Office Action dated Jun. 20, 2011, issued in corresponding Korean patent Application No. 10 2010 7008096.

(Continued)

*Primary Examiner* — Sumati Lefkowitz
*Assistant Examiner* — Rodney Amadiz
(74) *Attorney, Agent, or Firm* — Westerman, Hattori, Daniels & Adrian, LLP

(57) ABSTRACT

A display device includes: a matrix-type display element; a row driver that drives a scan electrode of the display element; and a column driver that drives a data electrode of the display element, in which the column driver includes a matrix driver in a segment mode, the row driver includes a matrix driver being switched between the segment mode and a common mode, and the writing of image data to the display element is performed by: invalidating the output of the row driver and the column driver; setting the row driver to the segment mode; and validating the output of the row driver and the column driver after writing selected line specification data to the row driver and writing image data to the column driver, and then setting the row driver to the common driver.

16 Claims, 25 Drawing Sheets

FOREIGN PATENT DOCUMENTS

| | | | |
|---|---|---|---|
| JP | 2-212886 | A | 8/1990 |
| JP | 4-062516 | A | 2/1992 |
| JP | 11-52916 | A | 2/1999 |
| JP | 2000-147466 | A | 5/2000 |
| JP | 2000-171837 | A | 6/2000 |
| JP | 2001-228459 | A | 8/2001 |
| JP | 2007-193199 | A | 8/2007 |
| WO | 2006/106559 | A1 | 10/2006 |
| WO | 2007/110948 | A1 | 10/2007 |

OTHER PUBLICATIONS

Chinese Office Action dated Feb. 13, 2012, issued in corresponding Chinese Patent Application No. 200780101115.8, (7 pages).

Y. -M. Zhu et al., "P-82: Cumulative Drive Schemes for Bistable Reflective Cholesteric LCDs," SID 98 Digest, 1998, pp. 798-801.

International Search Report of PCT/JP2007/070098, mailing date of Nov. 6, 2007.

* cited by examiner

| COMMON DRIVER | SEGMENT DRIVER | POSITIVE POLARITY | NEGATIVE POLARITY |
|---|---|---|---|
| ON | ON | 20 | -20 |
| | OFF | 10 | -10 |
| OFF | ON | 5 | -5 |
| | OFF | -5 | 5 |

FIG.10A

| /DSPOF | DATA LATCH SIGNAL | FR | DRIVER OUTPUT VOLTAGE | |
|---|---|---|---|---|
| HIGH | HIGH | HIGH | V0 | (SELECTED LEVEL) |
| | | LOW | V5 | |
| | LOW | HIGH | V21 | (NON-SELECTED LEVEL) |
| | | LOW | V34 | |
| LOW | - | - | V5 | - |

FIG.10B

| /DSPOF | DATA LATCH SIGNAL | FR | DRIVER OUTPUT VOLTAGE | |
|---|---|---|---|---|
| HIGH | HIGH | HIGH | V5 | (SELECTED LEVEL) |
| | | LOW | V0 | |
| | LOW | HIGH | V21 | (NON-SELECTED LEVEL) |
| | | LOW | V34 | |
| LOW | - | - | V5 | - |

DISPLAY DEVICE HAVING DISPLAY ELEMENT OF SIMPLE MATRIX TYPE, DRIVING METHOD OF THE SAME AND SIMPLE MATRIX DRIVER

CROSS-REFERENCE TO RELATED APPLICATIONS

This application is a continuation application and is based upon PCT/JP2007/070098, filed on Oct. 15, 2007, the entire contents of which are incorporated herein by reference.

FIELD

The embodiments discussed herein are related to a display device having a simple matrix-type display element, a driving method thereof and a simple matrix driver.

BACKGROUND

In recent years, the development of electronic paper has been promoted in companies, universities, etc. Applied fields expected to utilize electronic paper have been proposed, including a variety of fields, such as electronic books, a sub-display of mobile terminal equipment, and a display part of an IC card. One promising method of electronic paper is that which uses a cholesteric liquid crystal. A cholesteric liquid crystal has excellent characteristics, such as the ability to semipermanently hold a display (memory properties), vivid color display, high contrast, and high resolution.

As for the multi-gradation display method by cholesteric liquid crystal, there have been proposed various driving methods. The method of driving a multi-gradation display with a cholesteric liquid crystal is divided into a dynamic driving method and a conventional driving method.

Japanese Laid-open Patent Publication No. 2001-228459 describes a dynamic driving method. However, the dynamic driving method uses complicated drive waveforms, and therefore, requires a complicated control circuit and a driver IC and also requires a transparent electrode of the panel, having low resistance, resulting in a problem that the manufacturing cost is increased. Further, the dynamic driving method has a problem that power consumption is large.

Y.-M. Zhu, D-K. Yang, Cumulative Drive Schemes for Bistable Reflective Cholesteric LCDs, SID 98 DIGEST, p 798-801, 1998 describes a conventional driving method. This Non-patent document describes a method of driving the state gradually from a planar state to a focal conic state, or from the focal conic state to the planar state at a comparatively high semi-moving picture rate by making use of the cumulative time inherent in liquid crystal and adjusting the number of times of application of a short pulse.

However, in the driving method described in this non-patent document, because of such a high semi-moving picture rate, the drive voltage is as high as 50 to 70 V, and this is a factor that increases the cost. Further, the "two phase cumulative drive scheme" described in this non-patent document 1 uses the cumulative times in two directions, i.e., the cumulative time to the planar state and the cumulative time to the focal conic state using the two stages, i.e., the "preparation phase" and the "selection phase", and therefore, there is a problem of display quality. Further, a fine pulse is applied a number of times, and therefore, the driving method described in this non-patent document has a problem that power consumption is large.

Japanese Laid-open Patent Publication No. 2000-147466 and Japanese Laid-open Patent Publication No. 2000-171837 describe a method of driving a fast-forward mode that applies resetting to the focal conic state. This driving method has an advantage that a comparatively high contrast can be obtained compared to the above-mentioned driving method. However, the writing after resetting requires a high voltage that is difficult to achieve with a general-purpose STN driver, and further, the writing is cumulative toward the planar state, and therefore, the crosstalk to the half-selected or non-selected pixel becomes a problem. In addition, this driving method also has a problem that power consumption is large because a fine pulse is applied a number of times.

When a gradation is set by making use of the cumulative time using the conventional driving method, a method of varying the pulse width has been conceived, in addition to adjusting the number of short pulses as described above. Varying the pulse width is more advantageous than adjusting the number of times short pulses are applied from the standpoint of suppression of power consumption. Hereinafter, the method of setting a gradation by varying the pulse width to change the cumulative time is referred to as a PWM (Pulse Width Modulation) method.

Japanese Laid-open Patent Publication No. 04-62516 describes a configuration in which a positive polarity pulse and a negative polarity pulse having different pulse widths are applied to a liquid crystal display device, although the display device does not use a cholesteric liquid crystal.

SUMMARY

According to a first aspect of the embodiments, a display device includes: a display element of matrix type; a row driver that drives a scan electrode of the display element; and a column driver that drives a data electrode of the display element, wherein: the column driver includes a matrix driver in a segment mode; the row driver includes a matrix driver being switched between the segment mode and a common mode; and the writing of image data to the display element is performed by: invalidating the output of the row driver and the column driver; setting the row driver to the segment mode; and validating the output of the row driver and the column driver after writing selected line specification data to the row driver and writing image data to the column driver, and then setting the row driver to the common driver.

According to a second aspect of the embodiments, in a method of driving a display device, the display device including a display element of matrix type, a row driver that drives a scan electrode of the display element, and a column driver that drives a data electrode of the display element, the column driver includes a matrix driver in a segment mode and the row driver includes a matrix driver being switched between the segment mode and a common mode, display data is written to the display element by: invalidating the output of the row driver and the column driver; writing selected line specification data to the row driver and writing image data to the column driver in a state where the row driver is set to the segment mode; setting the row driver to the common mode; and validating the output of the row driver and the column driver.

According to a third aspect of the embodiments, a simple matrix driver that drives an electrode of a display element of matrix type, comprises: a segment mode; and a common mode, wherein when the driver writes display data to the display element, the driver operates to change into the segment mode after invalidating an output and to validate the output after reading selected line specification data and changing to the common mode.

The object and advantages of the embodiments will be realized and attained by means of the elements and combination particularly pointed out in the claims.

It is to be understood that both the foregoing general description and the following detailed description are exemplary and explanatory and are not restrictive of the invention, as claimed.

BRIEF DESCRIPTION OF THE DRAWINGS

FIG. 10A is a diagram illustrating output voltages when the general-purpose simple matrix driver is in a segment mode;

FIG. 10B is a diagram illustrating output voltages when the general-purpose simple matrix driver is in a common mode;

DESCRIPTION OF EMBODIMENTS

Before describing the embodiments, a basic configuration of a cholesteric liquid crystal display device is described as an example of a display element of simple matrix type having a display material with memory properties.

The cholesteric liquid crystal is also referred to as chiral nematic liquid crystal, which forms a cholesteric phase in which molecules of the nematic liquid crystal are in the form of a helix by adding a comparatively large amount (a few tens of percent) of additives (chiral material) having a chiral property to the nematic liquid crystal.

Figure 1A:
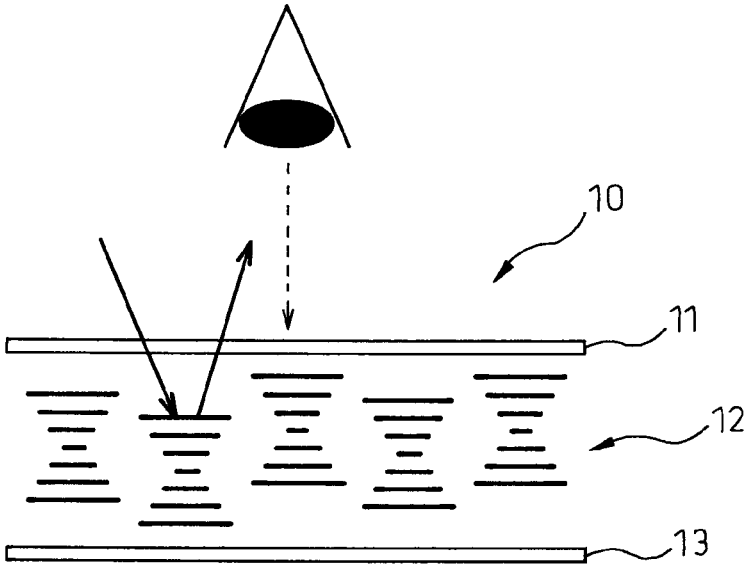
FIG. 1A is a diagram explaining a planar state of cholesteric liquid crystal.
Figure 1B:
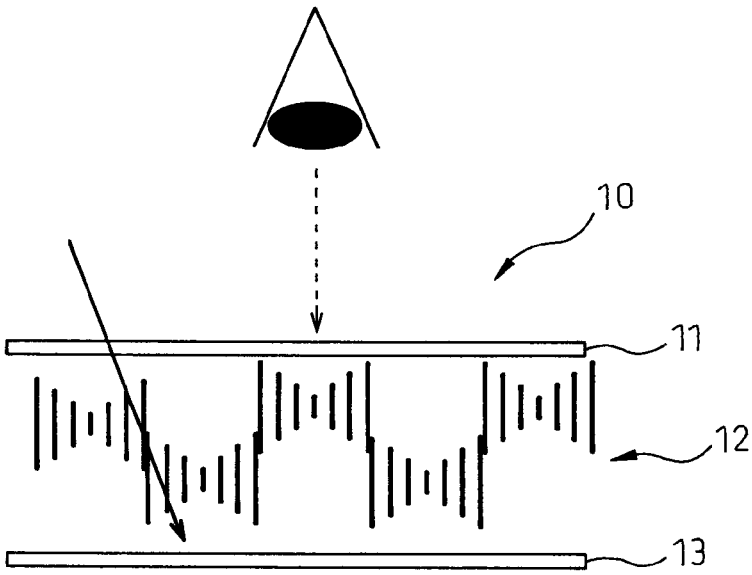
FIG. 1B is a diagram explaining a focal conic state of cholesteric liquid crystal.

FIG. 1A and FIG. 1B are diagrams explaining the states of the cholesteric liquid crystal. As illustrated in FIG. 1A and FIG. 1B, a display element 10 that utilizes cholesteric liquid crystal has an upper side substrate 11, a cholesteric liquid crystal layer 12, and a lower side substrate 13. The cholesteric liquid crystal has a planar state in which incident light is reflected as illustrated in FIG. 1A and a focal conic state in which incident light is transmitted as illustrated in FIG. 1B, and these states are maintained even if there is no electric field.

In the planar state, light having a wavelength in accordance with the helical pitch of liquid crystal molecules is reflected. A wavelength $\lambda$ at which reflection is maximum is expressed by the following expression where n is an average refractive index of the liquid crystal and p is a helical pitch.

$$\lambda = n \cdot p.$$

On the other hand, a reflection band $\Delta\lambda$ differs considerably depending on a refractive index anisotropy $\Delta n$ of liquid crystal.

In the planar state, a "bright" state, i.e., color in accordance with $\lambda$ can be displayed because incident light is reflected. On the other hand, in the focal conic state, a "dark" state, i.e., black can be displayed because light having passed through the liquid crystal layer is absorbed by a light absorbing layer provided under the lower side substrate 13.

Next, a method of driving a display element that utilizes cholesteric liquid crystal is explained.

Figure 2:
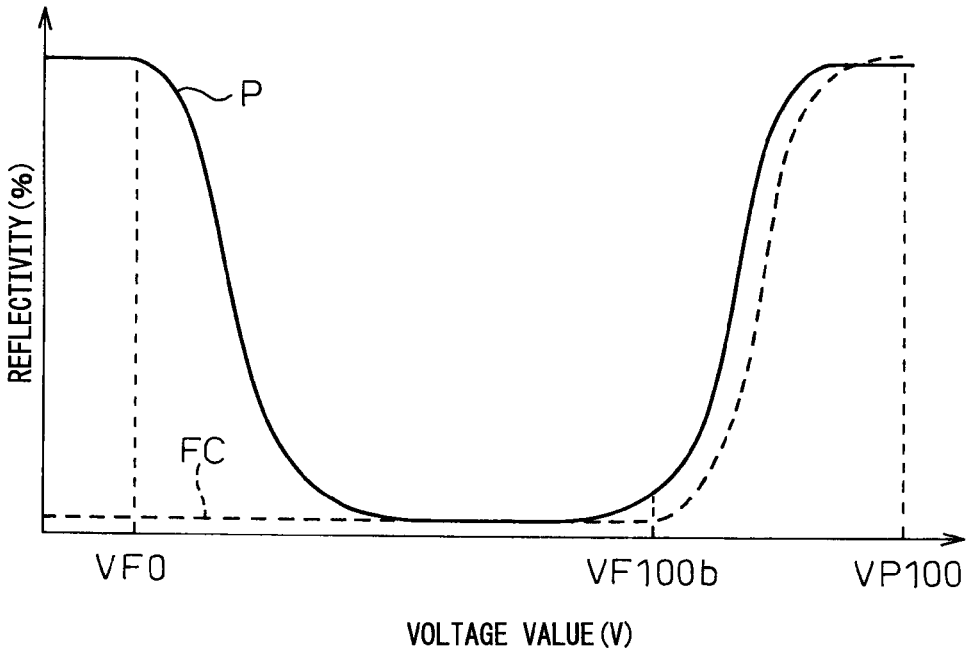
FIG. 2 is a diagram explaining a state change of cholesteric liquid crystal by a pulse voltage.

FIG. 2 illustrates an example of a voltage-reflection characteristic of general cholesteric liquid crystal. The horizontal axis represents a voltage value (V) of a pulse voltage to be applied with a predetermined pulse width between electrodes that sandwich cholesteric liquid crystal and the vertical axis represents a reflectivity (%) of cholesteric liquid crystal. A curve P of a solid line illustrated in FIG. 2 represents the voltage-reflectivity characteristic of the cholesteric liquid crystal when the initial state is the planar state and a curve FC of a broken line represents the voltage-reflectivity characteristic of the cholesteric liquid crystal when the initial state is the focal conic state.

In FIG. 2, if a predetermined high voltage VP100 (for example, ±36 V) is applied between the electrodes to generate a relatively strong electric field in the cholesteric liquid crystal, the helical structure of the liquid crystal molecules is undone completely and a homeotropic state is brought about, where all of the molecules align in the direction of the electric field. Next, when the liquid crystal molecules are in the homeotropic state, if the applied voltage is reduced rapidly from VP100 to a predetermined low voltage (for example, VF0=±4 V) to reduce the electric field in the liquid crystal almost to zero, the helical axis of the liquid crystal becomes perpendicular to the electrode and the planar state is brought about, where light in accordance with the helical pitch is reflected selectively.

On the other hand, if a predetermined low voltage VF100*b* (for example, ±24 V) is applied between electrodes to generate a relatively weak electric field in the cholesteric liquid crystal, a state is brought about where the helical structure of the liquid crystal molecules is not completely undone. In this state, if the applied voltage is reduced rapidly from VF100*b* to the low voltage VF0 to rapidly reduce the electric field in the liquid crystal almost to zero, or to gradually remove the electric field by applying a strong electric field, the helical axis of the liquid crystal molecule becomes parallel with the electrode and the focal conic state where incident light is transmitted is brought about.

Further, if the electric field is removed rapidly by applying an electric field of medium strength, the planar state and the focal conic state coexist in a mixed condition and it is possible to display a gradation.

A display is produced by utilizing the above-mentioned phenomena.

The principles of a driving method based on the voltage response characteristic described above are explained with reference to FIG. 3A to FIG. 3C.

Figure 3A:
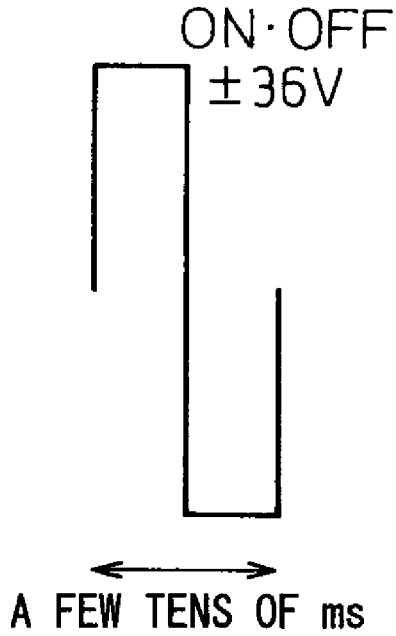
FIG. 3A is a diagram explaining a change in reflectivity by a pulse having a large voltage and a great pulse width to be applied to cholesteric liquid crystal.
Figure 3A:
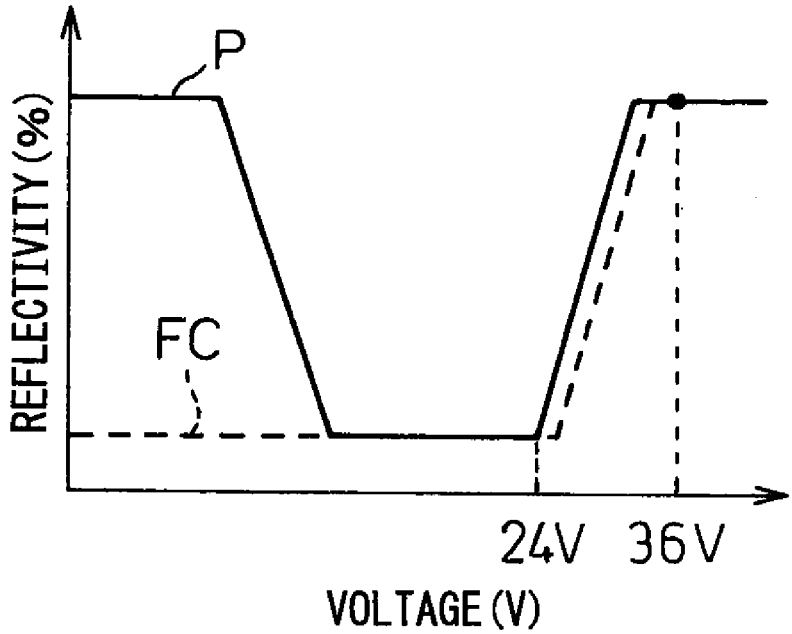
Figure 3B:
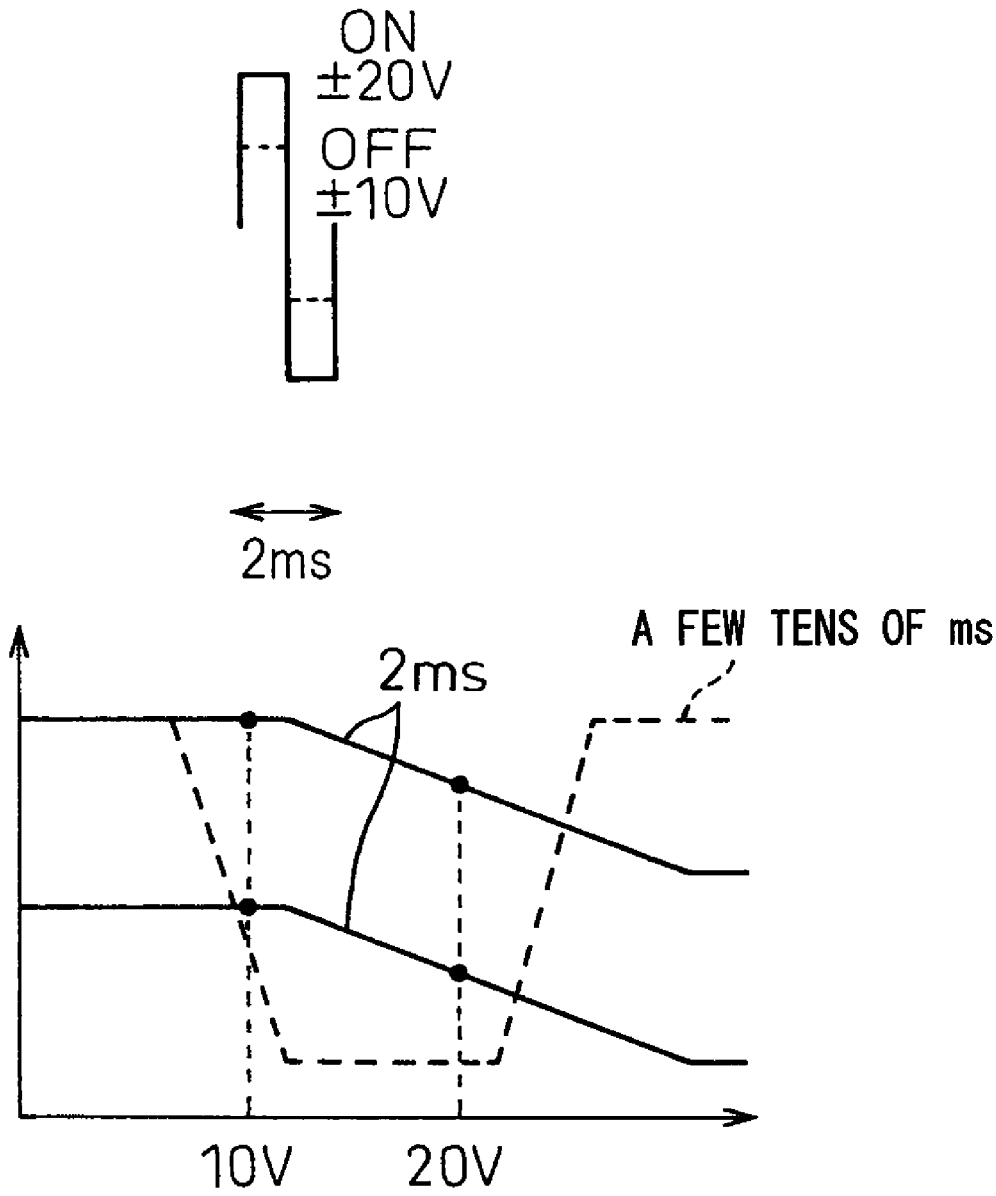
FIG. 3B is a diagram explaining a change in reflectivity by a pulse having an medium voltage and a narrow pulse width to be applied to cholesteric liquid crystal.
Figure 3C:
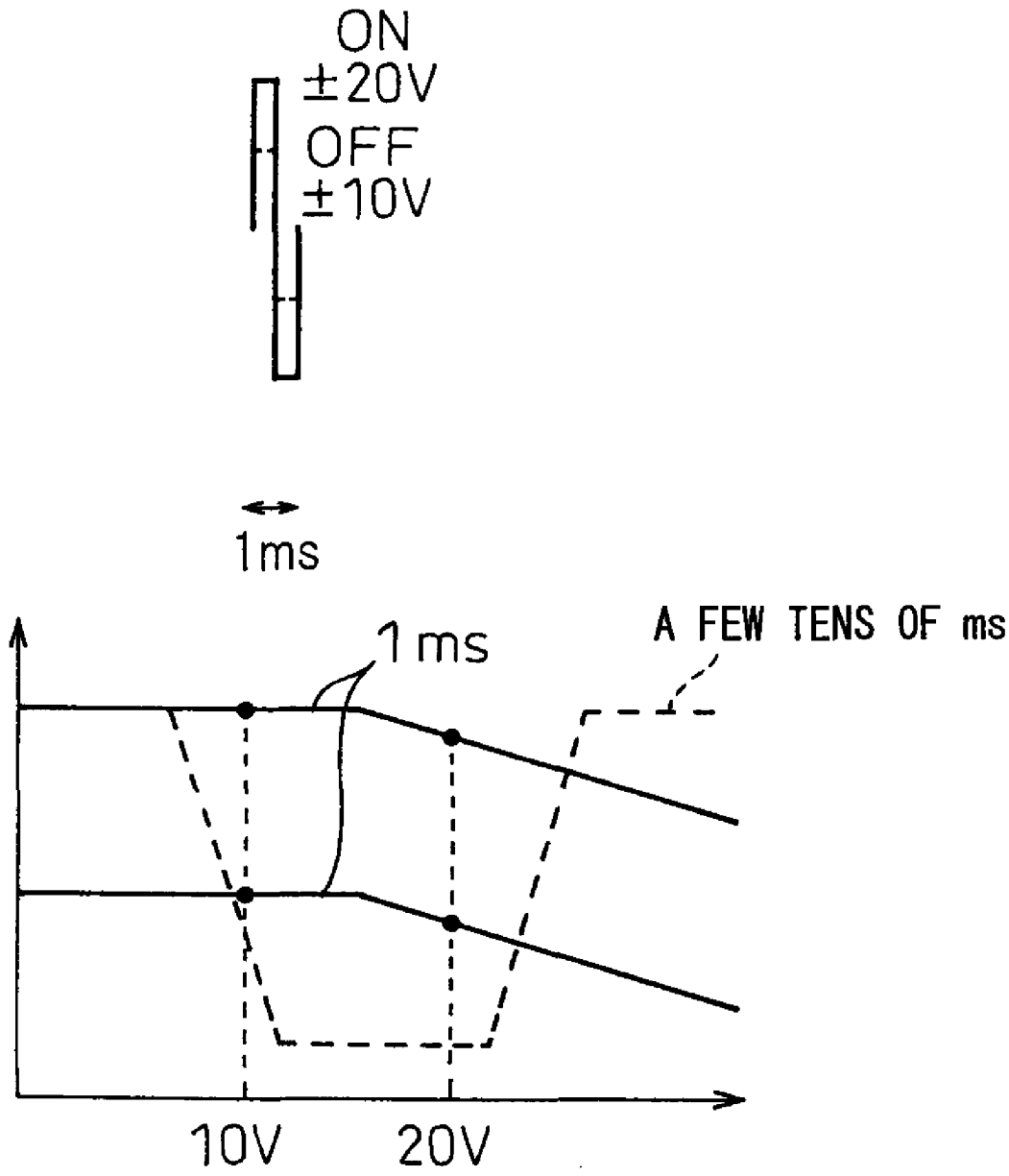
FIG. 3C is a diagram explaining a change in reflectivity by a pulse having an medium voltage and a narrower pulse width to be applied to cholesteric liquid crystal.

FIG. 3A illustrates the pulse response characteristic when the pulse width of a voltage pulse is a few tens of ms, FIG. 3B illustrates the pulse response characteristic when the pulse width of a voltage pulse is 2 ms, and FIG. 3C illustrates the pulse response characteristic when the pulse width of a voltage pulse is 1 ms. In each figure, a voltage pulse to be applied to cholesteric liquid crystal is illustrated on the upper side and the voltage-reflectivity characteristic is illustrated on the lower side, and the horizontal axis represents a voltage (V) and the vertical axis represents reflectivity (%). As a well-known drive pulse of a liquid crystal, voltage pulse is a combination of a positive polarity pulse and a negative polarity pulse in order to prevent liquid crystal from deteriorating due to polarization.

As illustrated in FIG. 3A, when the pulse width is great, as illustrated by the solid line, if the initial state is the planar state, the state changes into the focal conic state when the voltage is raised to a certain range and if the voltage is further raised, the state changes into the planar state again. As illustrated by the broken line, when the initial state is the focal conic state, the state gradually changes into the planar state as the pulse voltage is raised.

When the pulse width is great, the voltage pulse, at which the state changes into the planar state whether the initial state is the planar state or the focal conic state, is ±36 V in FIG. 3A. With a pulse voltage in the middle of this range, the state is such that the planar state and the focal conic state coexist mixedly, and therefore, a gradation can be obtained.

On the other hand, when the pulse width is 2 ms as illustrated in FIG. 3B, if the initial state is the planar state, the reflectivity remains unchanged when the voltage pulse is 10 V. However, at higher voltages, the planar state and the focal conic state coexist in a mixed condition, and therefore, the reflectivity is reduced. The amount of reduction in reflectivity increases as the voltage is increased. However, when the voltage is increased more than 36 V, the amount of reduction in reflectivity becomes constant. This is also the same when the initial state is a state where the planar state and the focal conic state coexist in a mixed condition. Because of this, when the initial state is the planar state, if a voltage pulse having a pulse width of 2 ms and a pulse voltage of 20 V is applied once, the reflectivity is reduced by a certain amount. In this manner, in the state where the planar state and the focal conic state coexist in a mixed condition and the reflectivity is reduced by a small amount, if a voltage pulse having a pulse width of 2 ms and a pulse voltage of 20 V is further applied, the reflectivity is reduced further. If this is repeated, the reflectivity is reduced to a predetermined value.

As illustrated in FIG. 3C, when the pulse width is 1 ms, the reflectivity is reduced when a voltage pulse is applied in a manner similar to that when the pulse width is 2 ms. However, the amount of reduction in reflectivity is smaller than when the pulse width is 2 ms.

From the above, it can be thought that if a pulse of 36 V having a pulse width of several ten milliseconds is applied, the state planar state is brought about and if a pulse of about ten-something to 20 V having a pulse width of 2 ms is applied, the state is brought about where the planar state and the focal conic state coexist in a mixed condition and the reflectivity is reduced, and the amount of reduction in reflectivity depends on the cumulative time of the pulse.

Figure 4A:
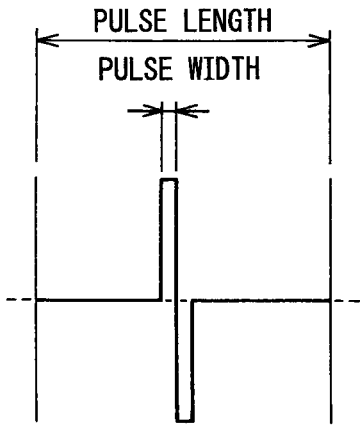
FIG. 4A is a diagram illustrating an example in which the pulse width of a symmetric pulse to be applied to liquid crystal is narrow.
Figure 4B:
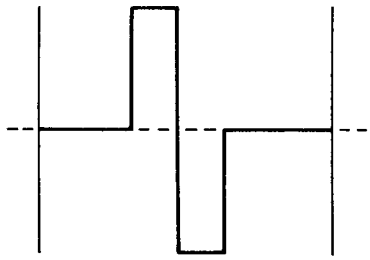
FIG. 4B is a diagram illustrating an example in which the pulse width of a symmetric pulse to be applied to liquid crystal is medium.
Figure 4C:
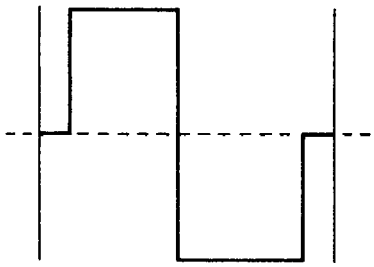
FIG. 4C is a diagram illustrating an example in which the pulse width of a symmetric pulse to be applied to liquid crystal is great.

FIG. 4A to FIG. 4C illustrate examples of pulses of different pulse widths, wherein the pulse width is longer in order of FIG. 4A, FIG. 4B and FIG. 4C. The pulses illustrated in FIG. 4A to FIG. 4C have the same length of one unit pulse and have a positive polarity pulse and a negative polarity pulse of different pulse widths. By making use of such a pulse, it is possible to prevent deterioration due to the polarization of liquid crystal.

Figure 5:
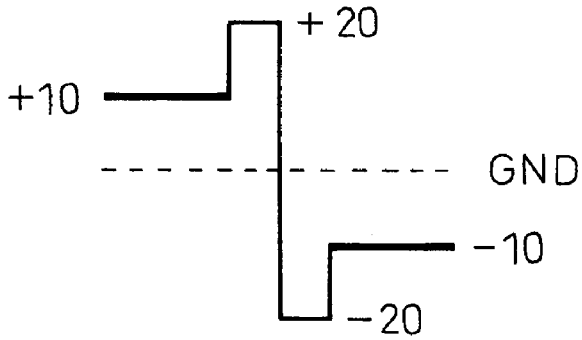
FIG. 5 is a diagram illustrating an example of a symmetric pulse to be applied to cholesteric liquid crystal.

As described above, the methods of varying a gradation by varying the cumulative time include the method of varying the number of short pulses and the method of varying the pulse width (PWM method). In the former method, voltages as illustrated in FIG. 3*b*, FIG. 3*c*, and in the latter method, voltages as illustrated in FIG. 5 are applied to a pixel. The cholesteric liquid crystal changes its state when a large voltage is applied whether the voltage is positive or negative. In a liquid crystal display device that uses cholesteric liquid crystal, scan lines extending in the transverse direction are written one by one and an action to shift the scan line to be written is repeated. In order to do so, the selected scan line is set to the ground level and a voltage of medium magnitude (for example, 15 V) is applied to other non-selected scan lines. To a data line that extends in the longitudinal direction, a pulse having a large voltage (20 V) is applied, however, if the voltage of the part other than the pulse width is set to the ground level, a large voltage having the opposite polarity (−15 V) is applied to the pixel of the non-selected line, and therefore, the state of the liquid crystal changes. In order to prevent such a change, in a liquid crystal display device that uses cholesteric liquid crystal, a pulse having a base voltage of +10 V and a pulse voltage of +20 V is used in the positive polarity phase and a pulse having a base voltage of −10 V and a pulse voltage of −20 V is used in the negative polarity phase as illustrated in FIG. 5. Because of this, +5 V or −5 V is applied to the pixel of the non-selected scan line and the state of the liquid crystal does not change. In the selected scan line, +20 V or −20V is applied to the pulse part and +10 V or −10 V is applied to other base parts.

Figure 6:
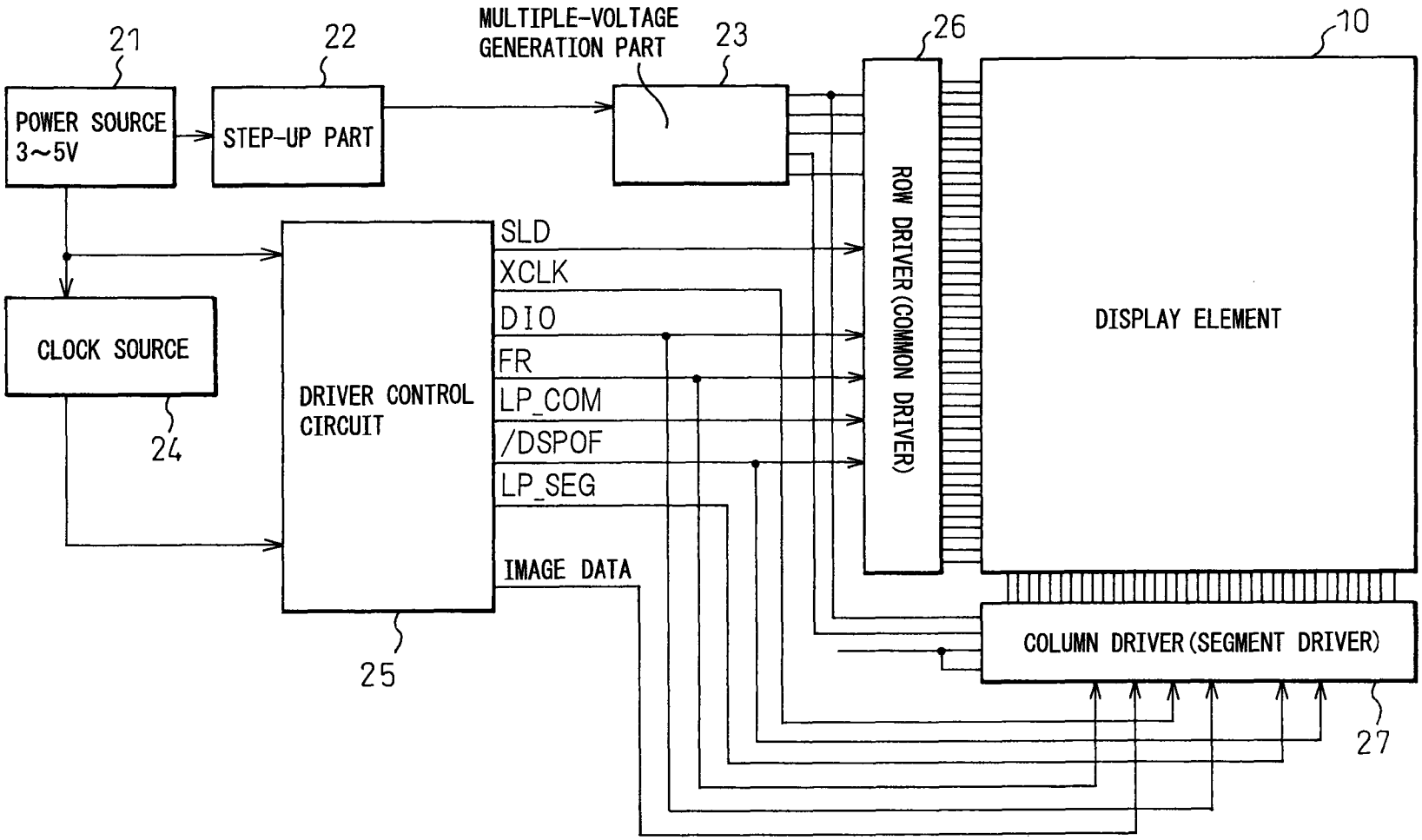
FIG. 6 is a diagram illustrating a general configuration of a conventional display device that uses cholesteric liquid crystal.

FIG. 6 is a diagram illustrating a configuration of the entire display device in the conventional example that uses the display element 10 of simple matrix type having a display material with memory properties, such as cholesteric liquid crystal. For example, the display element 10 is in conformity with the A4 size/XGA specifications and has 1,024×768 pixels. A power source 21 outputs a voltage of, for example, 3 V to 5V. A step-up part 22 steps up an input voltage from the power source 21 to 36 V to 40 V by a regulator, such as a DC-DC converter. A multiple-voltage generation part 23 generates a plurality of voltages to be supplied to a row driver (common driver) 26 and a column driver (segment driver) 27 from the step-up converter. A clock source 24 outputs clocks used to control each part. A driver control circuit 25 outputs several control signals and controls the row driver 26 and the column driver 27. Scan line data SLD is data that the row driver 26 lathes and shifts sequentially. A data take-in clock XCLK is a clock with which the column driver 27 internally transfers image data. A frame start signal DIO is a signal that specifies the update of a display line. A pulse polarity control signal FR is used to select a polarity of voltage applied to liquid crystal pixels. A scan shift signal LP_COM is a signal that specifies the update of a display line in the row driver 26. /DSPOF is a forced OFF signal of an applied voltage. A column data latch signal LP_SEG is a signal that specifies the update of a display line in the column driver 27. To the column driver 27, image data is input.

The row driver (common driver) 26 drives the 768 scan lines and the column driver (segment driver) 27 drives the 1,024 data lines. Because image data given to each pixel of RGB are different, the column driver 27 drives each data line independently. The row driver 26 drives the lines of RGB commonly. As the row driver (common driver) 26 and the column driver (segment driver) 27, a simple matrix driver that output two values is used, respectively. Widely-used driver ICs include a common driver IC and a segment driver IC and in addition, there is an IC that can be used as a common driver and a segment driver in accordance with a voltage to be applied to a mode switch terminal.

Figure 7:
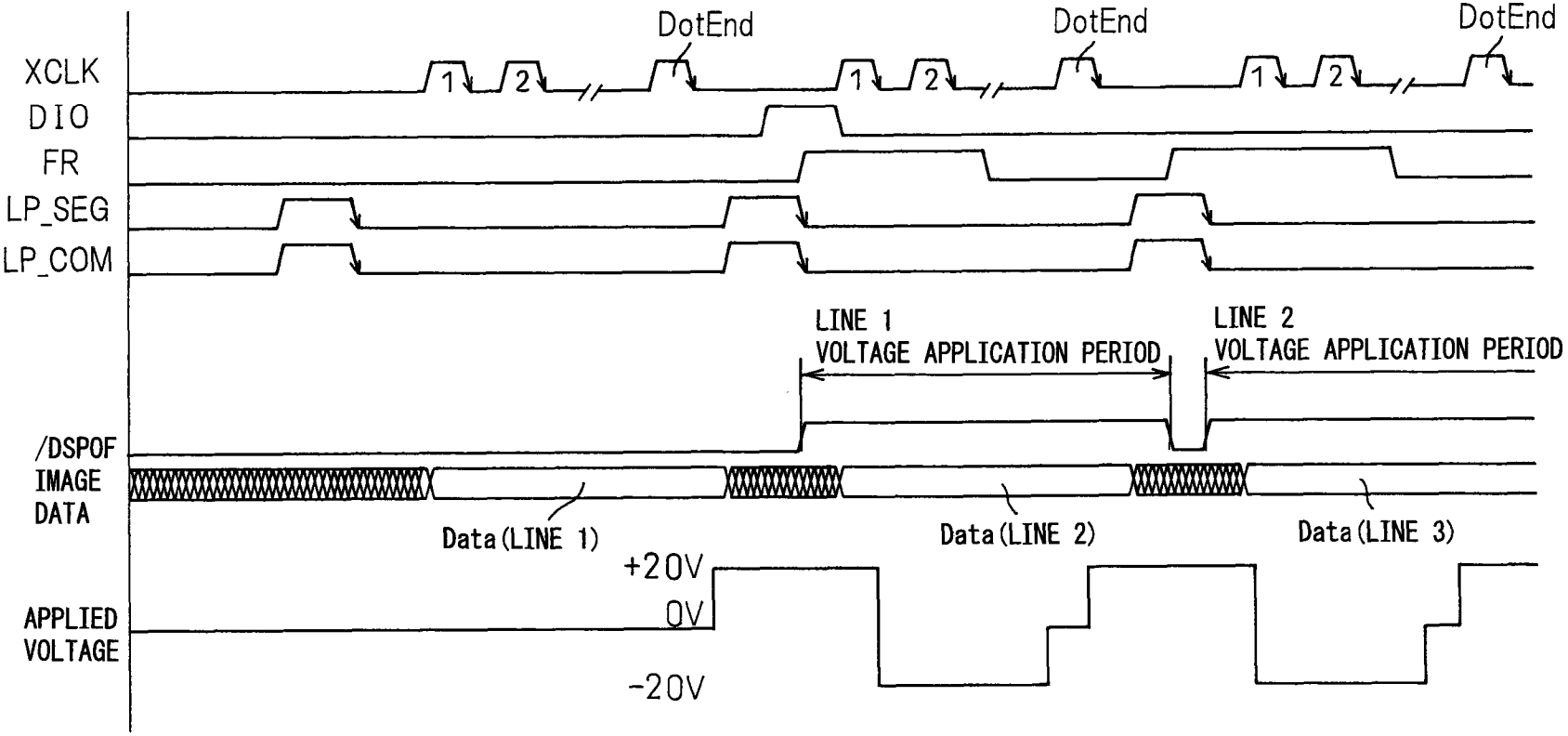
FIG. 7 is a time chart illustrating a drive sequence of a conventional display device.

FIG. 7 is a time chart illustrating a drive sequence of the gradation write operation in the conventional display device in FIG. 6. When the display line is updated by applying LP_COM and LP_SEG, the column driver 27 is supplied with data corresponding to one line in accordance with XCLK, and when the data of 1,024 pixels is shifted and pixel data corresponding to one line is prepared, if LP_COM and LP_SEG are applied, the row driver 26 outputs a pulse in the positive polarity phase to one scan line and the column driver 27 outputs a pulse in the positive polarity phase in accordance with the image data corresponding to one line to the 1,024 data lines. When the application of the pulse in the positive polarity phase is completed, a pulse in the negative polarity phase is applied. In parallel with this, pixel data corresponding to the next one line is supplied in the same manner described above. After that, the same processing is repeated and pulses in the positive polarity and negative polarity phases in accordance with the display data are applied to the entire screen. When the cumulative application time of a pulse in accordance with a gradation level is adjusted by the number of pulses, the number of times of application of a pulse is varied for each data line and when the cumulative application time is adjusted by the pulse length, the width of a pulse to be applied is varied for each data line.

In the reset processing to bring all of the pixels into the planar state, symmetric pulses of a high voltage (for example, 36 V) having a great pulse width in the positive polarity and negative polarity phases are applied to all of the pixels.

The driving method illustrated in FIG. 7 is widely known, and therefore, more explanation is omitted here.

Figures 8A, 8B:
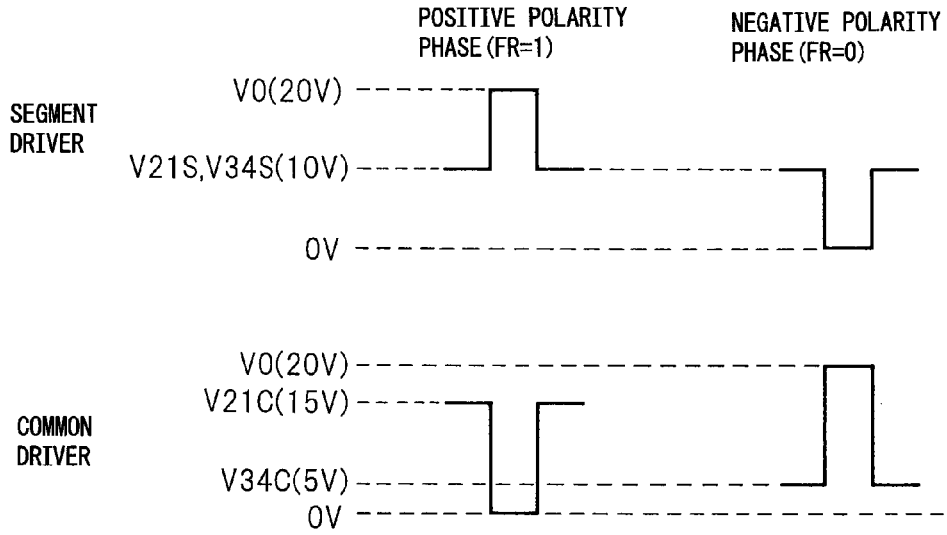
FIG. 8A is a diagram illustrating output pulses of a general-purpose segment driver and a general-purpose common driver in a display device.
FIG. 8B is a diagram illustrating voltages to be applied to liquid crystal by the output pulses in FIG. 8A.

In a display device that uses cholesteric liquid crystal, a column driver (segment driver) and a row driver (common driver) output, for example, pulses as illustrated in FIG. 8A as a gradation pulse to be applied to change the planar state into a gradation level. By applying such pulses, voltages as illustrated in FIG. 8B are applied to a pixel.

To the column driver, 20 V is supplied as V0, and 10 V as V21S and V34S, and as illustrated in FIG. 8A, in the positive polarity phase (FR=1), a positive pulse is output and in the negative polarity phase (FR=0), a negative pulse is output.

To the row driver, 20 V is supplied as V0, 15 V as V21C, and 5 V as V34C, and as illustrated in FIG. 8A, in the positive polarity phase (FR=1), a negative pulse is output and in the negative polarity phase (FR=0), a positive pulse is output.

Because such pulses illustrated in FIG. 8A are applied, when the scan line is in the selected state (the common driver is ON) and the data line is also in the selected state (the segment driver is ON), 20 V (measured from common line) is applied in the positive polarity phase (FR=1) and −20 V (measured from common line) is applied in the negative polarity phase (FR=0). When the scan line is in the selected state (the common driver is ON) and the data line is in the non-selected state (the segment driver is OFF), 10 V (measured from common line) is applied in the positive polarity phase (FR=1) and −10 V (measured from common line) is applied in the negative polarity phase (FR=0). When the scan line is in the non-selected state (the common driver is OFF) and the data line is in the selected state (the segment driver is ON), 5 V (measured from common line) is applied in the positive polarity phase (FR=1) and −5 V (measured from common line) is applied in the negative polarity phase (FR=0). When the scan line is in the non-selected state (the common driver is OFF) and the data line is in the non-selected state (the segment driver is OFF), −5 V (measured from common line) is applied in the positive polarity phase (FR=1) and 5 V (measured from common line) is applied in the negative polarity phase (FR=0).

It is common for the row driver and the common driver of the display device in FIG. 6 to be configured by a general-purpose simple matrix driver IC as described above. General-purpose driver ICs include, in addition to the segment driver IC and the common driver IC, an IC capable of being selected to be used as a segment driver or a common driver by the voltage level to be applied to made selection terminal. As such an IC, mention is made of, for example, the STN liquid crystal driver S1D17A03/S1D17A04 made by SEIKO EPSON CORPORATION.

Figure 9:
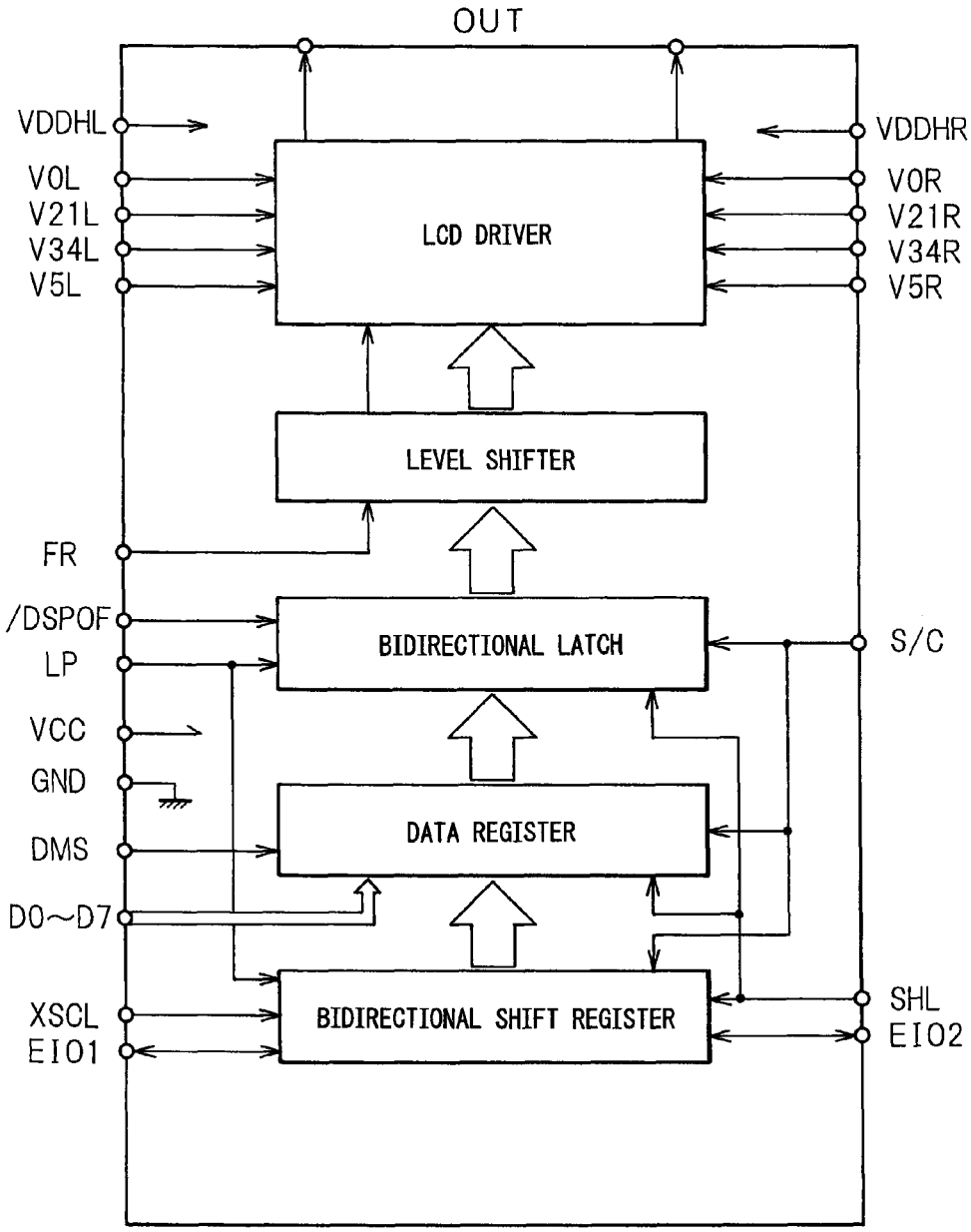
FIG. 9 is a diagram illustrating a configuration of a general-purpose simple matrix driver.

FIG. 9 is a diagram illustrating a block configuration and input/output signals of a simple matrix driver IC having a mode selection function capable of being selected to be used as a segment driver or a common driver. In order to be used as a segment driver or a common driver, there are provided a shift register, a data register, and a latch.

FIG. 10A illustrates a diagram illustrating a relationship between input signal and output voltage in the segment mode of the simple matrix driver IC having a mode selection function in FIG. 9, and FIG. 10B is a diagram illustrating a relationship between input signal and output voltage in the common mode of the simple matrix driver IC having a mode selection function in FIG. 9.

As illustrated in FIG. 10A, the driver in the segment mode produces an output in accordance with a data latch signal when the output control signal /DSPOF is at "H (HIGH: 1)" level and the output when /DSPOF is at "L (LOW: 0)" level is a predetermined value V5 (for example, GND). When the data latch signal is "1", the driver outputs V0 (20 V) when the polarity control signal FR is "1" and outputs the ground level V5 (GND) when the polarity control signal FR is "0", and when the data signal is "0", the driver outputs V21 (10 V) when the polarity control signal FR is "1" and outputs V34 (10 V) when the polarity control signal FR is "0". Here, V0, V21, and V34 are voltages to be supplied to the driver from outside and they need to satisfy the restriction condition V0≧V21≧V34≧GND.

As illustrated in FIG. 10B, the driver in the common mode produces an output in accordance with the data latch signal when the output control signal /DSPOF is at "H (HIGH: 1)" level and the output when /DSPOF is at "L (LOW: 0)" level is the predetermined value V5 (for example, GND). When the data signal is "1", the driver outputs V5 (GND) when the polarity control signal FR is "1" and outputs V0 (20 V) when the polarity control signal FR is "0", and when the data signal is "0", the driver outputs V21 (15 V) when the polarity control signal FR is "1" and outputs V34 (5 V) when the polarity control signal FR is "0". V0, V21, and V34 are voltages to be supplied to the driver from outside and they need to satisfy the restriction condition V0≧V21≧V34≧GND.

Figure 11:
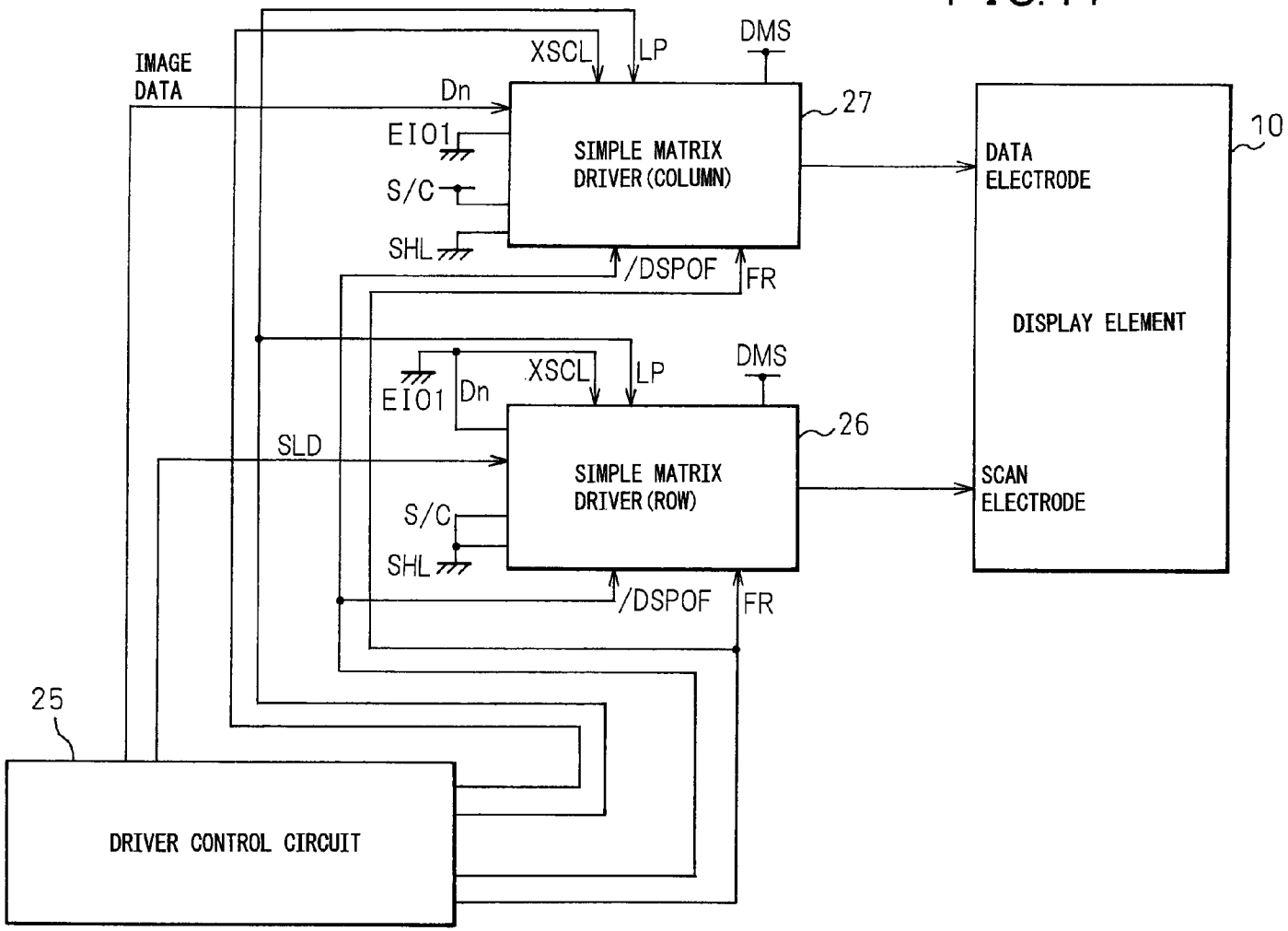
FIG. 11 is a diagram illustrating a general configuration of a conventional display device that uses a general-purpose simple matrix driver.

FIG. 11 is a block diagram illustrating a configuration of a display device configured by using the simple matrix driver IC having a mode selection function in FIG. 9. In FIG. 11, only the display element 10, the driver control circuit 25, the row driver 26 configured by a simple matrix driver, and the column driver 27 configured by a simple matrix driver are illustrated and the other parts are not illustrated schematically.

As illustrated in FIG. 11, a mode selection terminal S/C of the row driver 26 is connected to GND and the common mode is set. The mode selection terminal S/C of the column driver 27 is connected to the HIGH terminal and the segment mode is set. The pulse polarity control signal FR and the output control signal /DSPOF are input commonly to the two drivers. To an XSCL terminal of the column driver 27, a shift clock of image data is input and to an LP terminal, a latch pulse is input. The latch pulse is also input to the LP terminal of the row driver 26 and acts as a line shift clock. To the data input terminal (D0-D7 for an 8-bit input) of the column driver 27, image data is input. To an enable terminal EIO1 of the row driver 26, the scan line data SLD is input. In the normal scan operation, SLD turns to 1 at the time of start and it is maintained to be 0 afterward. An explanation of the other terminals is omitted. Further, the control signals are basically the same as those in FIG. 7, and therefore, their detailed explanation is omitted.

In a standard operation sequence of a common driver of a cholesteric liquid crystal display device of simple matrix-type, after a first scan electrode $Y_i$ is selected as a line to be written, a line shift clock is input and thus the selected line is moved sequentially. It is easy to write a display line one by one as described above.

Figure 12A:
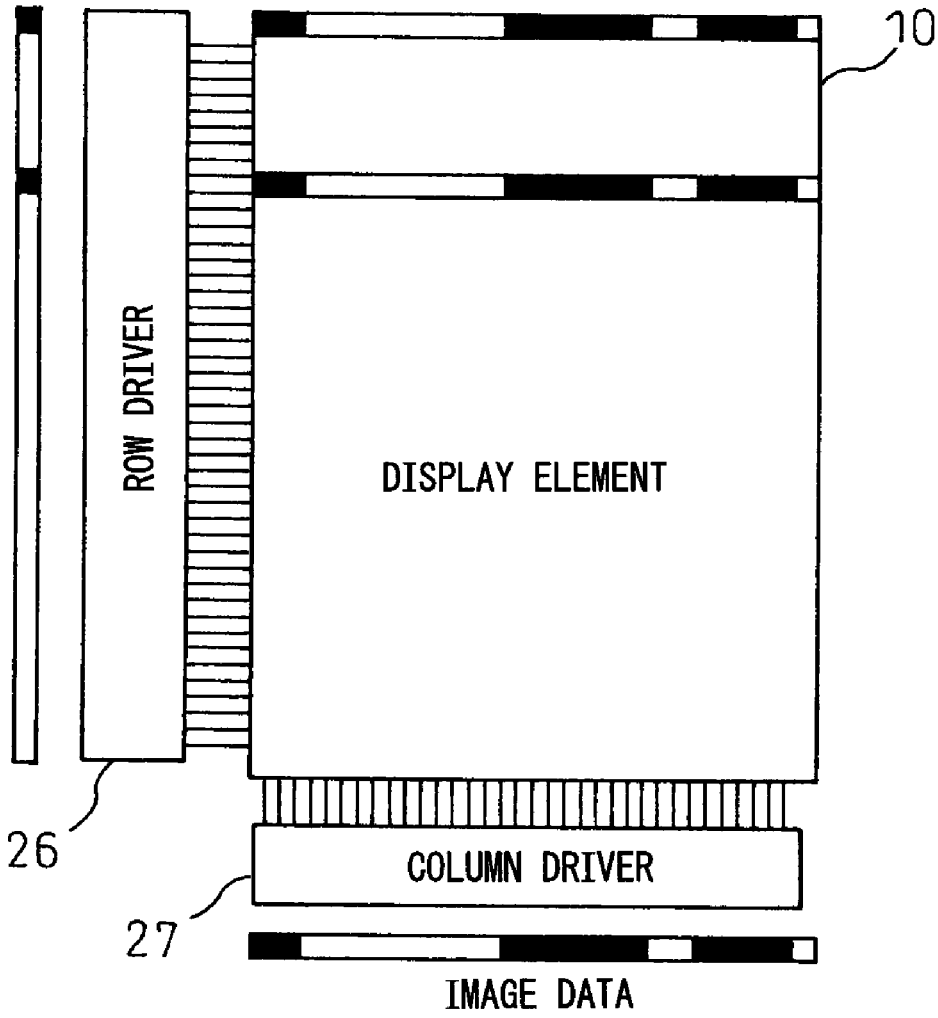
FIG. 12A is a diagram explaining an example in which a plurality of lines are driven simultaneously.
Figure 12B:
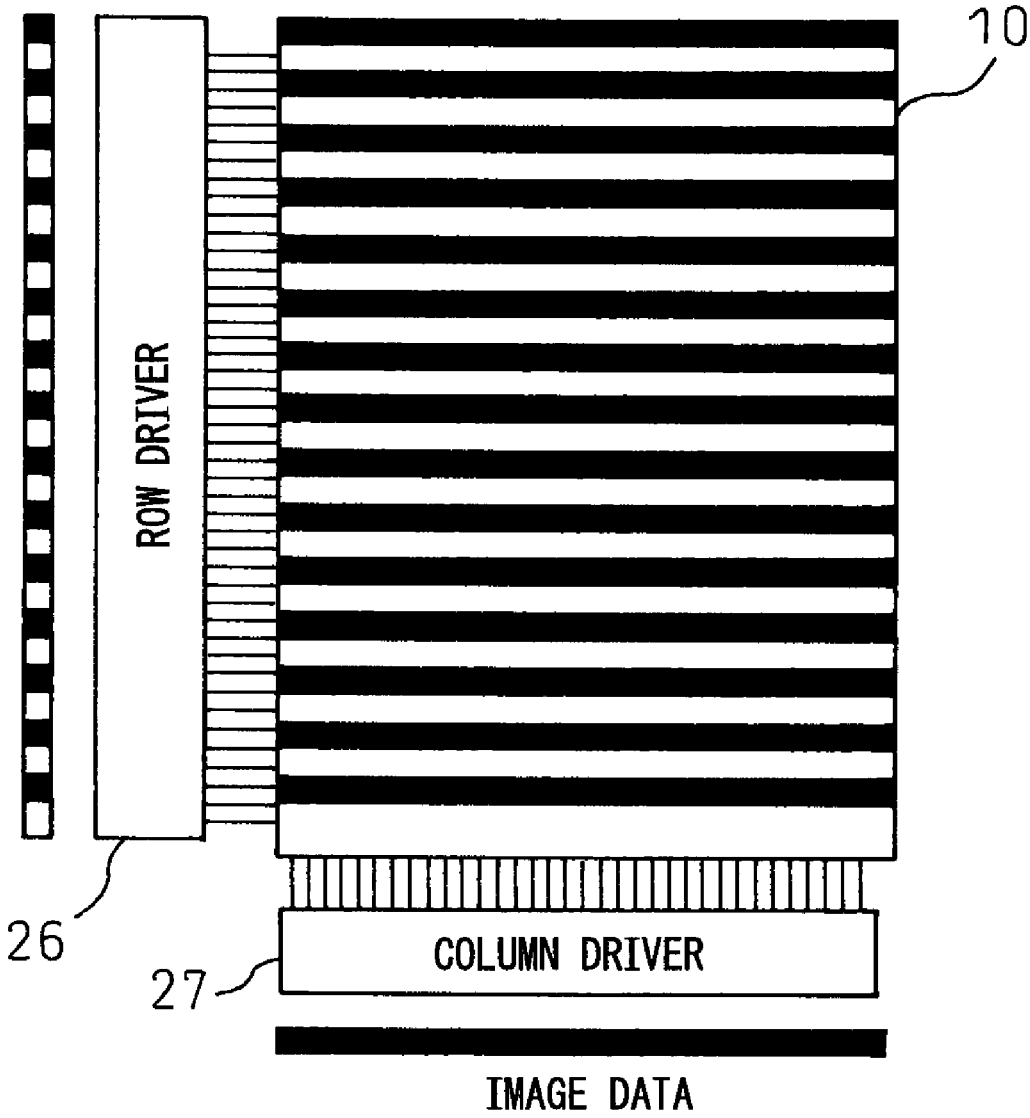
FIG. 12B is a diagram explaining an example in which a plurality of lines are driven simultaneously.

If lines having the same image data, such as a horizontal line and a white or black strip, are written at the same time, the write speed of the display device can be increased, and therefore, it is demanded to enable such write processing. FIG. 12A and FIG. 12B are diagrams explaining such write processing. FIG. 12A illustrates a case where two lines having the same image data are written at the same time. FIG. 12B illustrates a case where a number of lines constituting the black part of a strip-like pattern are written at the same time.

WO2006/106559A1 describes a configuration in which a sequence to write from an arbitrary scan electrode $Y_k$ by the common driver is realized, instead of that the selected line is moved sequentially. According to the above configuration, after the first scan electrode $Y_i$ is selected as a line to be written, a line shift clock the period of which is sufficiently shorter than the response time of the display element is input successively, and thus, the selected line is moved to $Y_i$ without changing the display.

However, for the above driving method, in order to randomly set a selected line to be written, it is necessary to (1) convert specification data of a selected line into serial data and to (2) control to increase or not the clock frequency depending on whether a selected line or a non-selected line, and therefore, the circuit becomes complicated. Because of this, this method can be used to search for the top successive line that does not require a complicated circuit. However, it results higher cost when used otherwise.

According to embodiments described later, it becomes possible to randomly select lines to be written that are not successive in a drive control device of a cholesteric liquid crystal display element of simple matrix type.

The embodiments are explained below with reference to the drawings.

Figure 13:
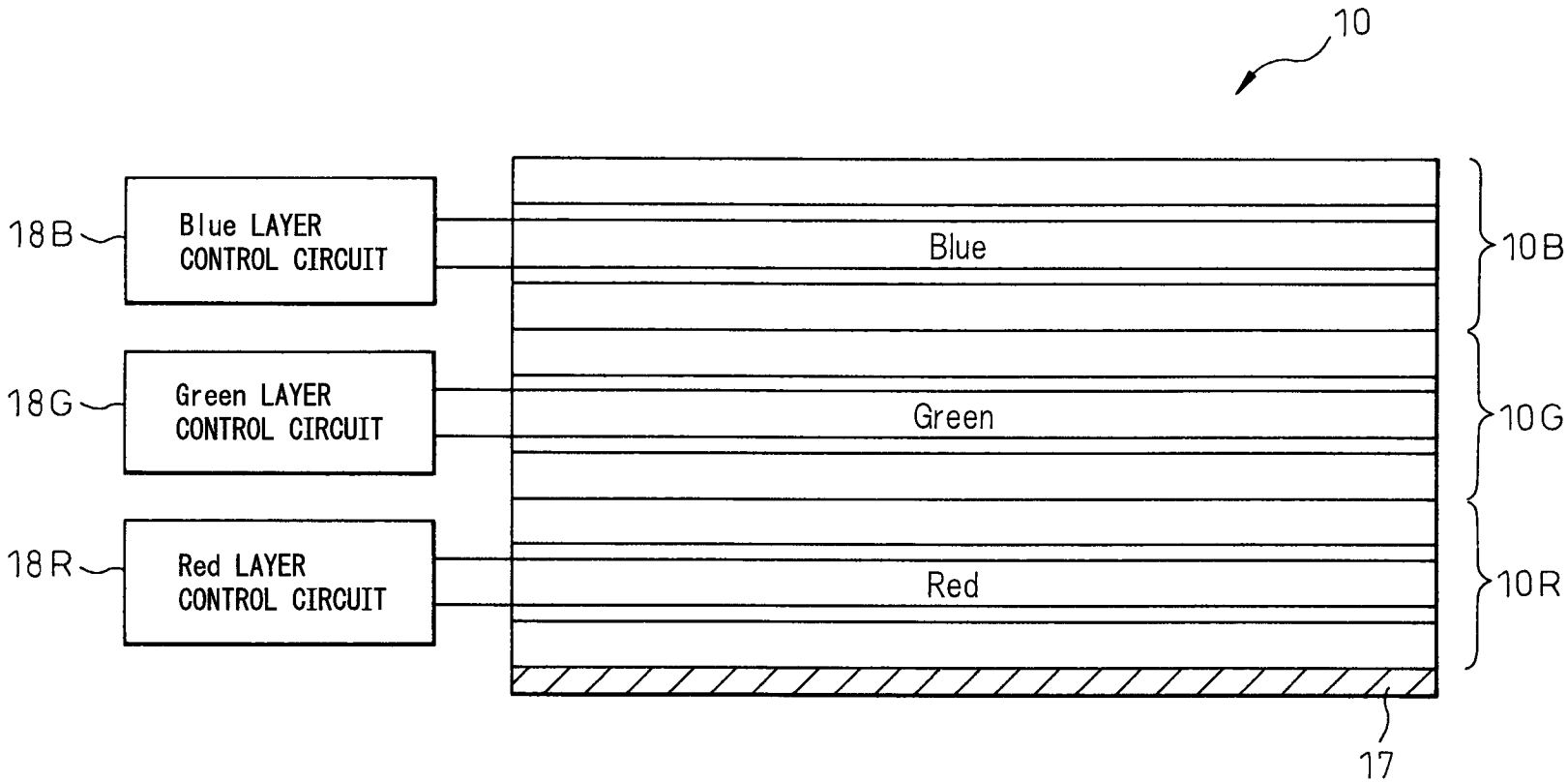
FIG. 13 is a diagram illustrating a laminated structure of a cholesteric liquid crystal element of a color display device in embodiments.

FIG. 13 is a diagram illustrating a configuration of a display device 10 used in embodiments. As illustrated in FIG. 13, in the display device 10, three panels are stacked into a layer, i.e., a panel 10B for blue, a panel 10G for green and a panel 10R for red in the order from the view side, and a light absorbing layer 17 is provided under the panel 10R for red. The panels 10B, 10G and 10R have the same configuration; however, the liquid crystal material and chiral material are selected and the content of the chiral material is determined so that the center wavelength of reflection of the panel 10B is blue (about 480 nm), the center wavelength of reflection of the panel 10G is green (about 550 nm), and the center wavelength of reflection of the panel 10R is red (about 630 nm). The panels 10B, 10G and 10R are driven by a blue layer control circuit 18B, a green layer control circuit 18G and a red layer control circuit 18R, respectively.

Figure 14:
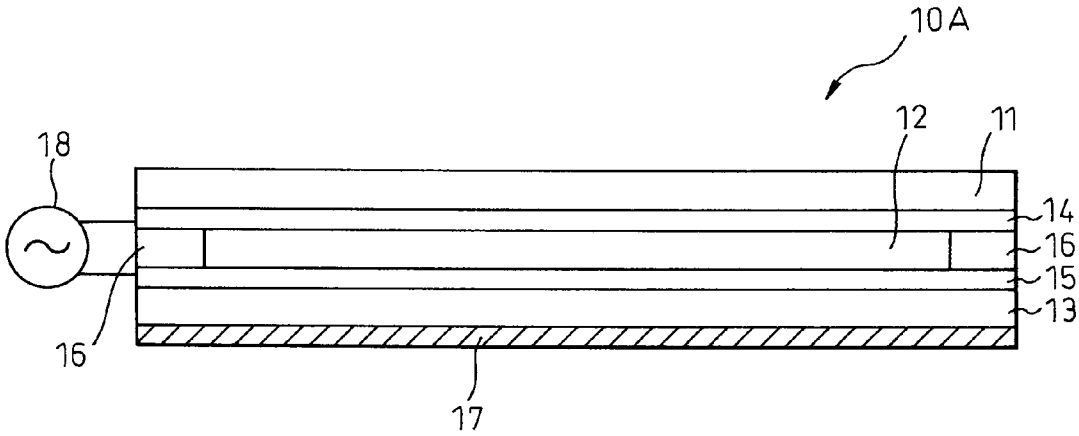
FIG. 14 is a diagram illustrating a structure of one cholesteric liquid crystal element of a color display device in embodiments.

FIG. 14 is a diagram illustrating a basic configuration of the single panel 10A The panel used in the embodiment is explained with reference to FIG. 14.

As illustrated in FIG. 14, the display device 10A has an upper side substrate 11, an upper side electrode layer 14 provided on the surface of the upper side substrate 11, a lower side electrode layer 15 provided on the surface of a lower side substrate 13, and a sealing material 16. The upper side substrate 11 and the lower side substrate 13 are arranged so that their electrodes are in opposition to each other and after a liquid crystal material is sealed in between, they are sealed with the sealing material 16. Within a liquid crystal layer 12, a spacer is arranged; however, it is not illustrated schematically. To the electrodes of the upper side electrode layer 14 and the lower side electrode layer 15, a voltage pulse signal is applied from a drive circuit 18 and due to this, a voltage is applied to the liquid crystal layer 12. A display is produced by applying a voltage to the liquid crystal layer 12 to bring the liquid crystal molecules of the liquid crystal layer 12 into the planar state or the focal conic state.

The upper side substrate 11 and the lower side substrate 13 both have translucency, however, the lower side substrate 13 of the panel 10R does not need to have translucency. Substrates having translucency include a glass substrate. However, in addition to the glass substrate, a film substrate of PET (polyethylene terephthalate) or PC (polycarbonate) may be used.

As the material of the electrode of the upper side electrode layer 14 and the lower side electrode layer 15, a typical one is, for example, indium tin oxide (ITO), however, other transparent conductive films, such as indium zinc oxide (IZO), can be used.

The transparent electrode of the upper side electrode layer 14 is formed on the upper side substrate 11 as a plurality of upper side transparent electrodes in the form of a belt in parallel with each another, and the transparent electrode of the lower side electrode layer 15 is formed on the lower side substrate 13 as a plurality of lower side transparent electrodes in the form of a belt in parallel with each other. Then, the upper side substrate 11 and the lower side substrate 13 are arranged so that the upper side electrode and the lower side electrode intersect each other when viewed in a direction vertical to the substrate and a pixel is formed at the intersection. On the electrode, a thin insulating film is formed. If the thin film is thick, it is necessary to increase the drive voltage. Conversely, if no thin film is provided, a leak current flows, and therefore, there arises a problem that power consumption is increased. The dielectric constant of the thin film is about 5, which is considerably lower than that of the liquid crystal, and therefore, it is appropriate to set the thickness of the thin film to about 0.3 μm or less.

The thin insulating film can be realized by a thin film of $SiO_2$ or an organic film of polyimide resin, acryl resin, etc., known as an alignment stabilizing film.

As described above, the spacer is arranged within the liquid crystal layer 12 and the separation between the upper side substrate 11 and the lower side substrate 13, i.e., the thickness of the liquid crystal layer 12 is made constant. Generally, the spacer is a sphere made of resin or inorganic oxide. However, it is also possible to use a fixing spacer obtained by coating a thermoplastic resin on the surface of the substrate. An appropriate range of the cell gap formed by the spacer is 3.5 μm to 6 μm. If the cell gap is less than this value, reflectivity is reduced, resulting in a dark display, or conversely, if the cell gap is greater than this value, the drive voltage is increased.

The liquid crystal composite that forms the liquid crystal layer 12 is cholesteric liquid crystal, which is nematic liquid crystal mixture to which a chiral material of 10 to 40 weight percent (wt %) is added. Here, the amount of the added chiral material is the value when the total amount of the nematic liquid crystal component and the chiral material is assumed to be 100 wt %.

As the nematic liquid crystal, various liquid crystal materials publicly known conventionally can be used. However, it is desirable to use a liquid crystal material the dielectric constant anisotropy ($\Delta\epsilon$) of which is in the range of 15 to 35. When the dielectric constant anisotropy is 15 or more, the drive voltage becomes comparatively low and if greater than the range, the drive voltage itself is reduced. However, the specific resistance is reduced and power consumption is increased particularly at high temperatures.

It is desirable for the refractive index anisotropy ($\Delta n$) to be 0.18 to 0.24. When the refractive index anisotropy is smaller than this range, the reflectivity in the planar state is reduced and when larger than this range, the scattering reflection in the focal conic state is increased and further, the viscosity is also increased and the response speed is reduced.

Figure 15:
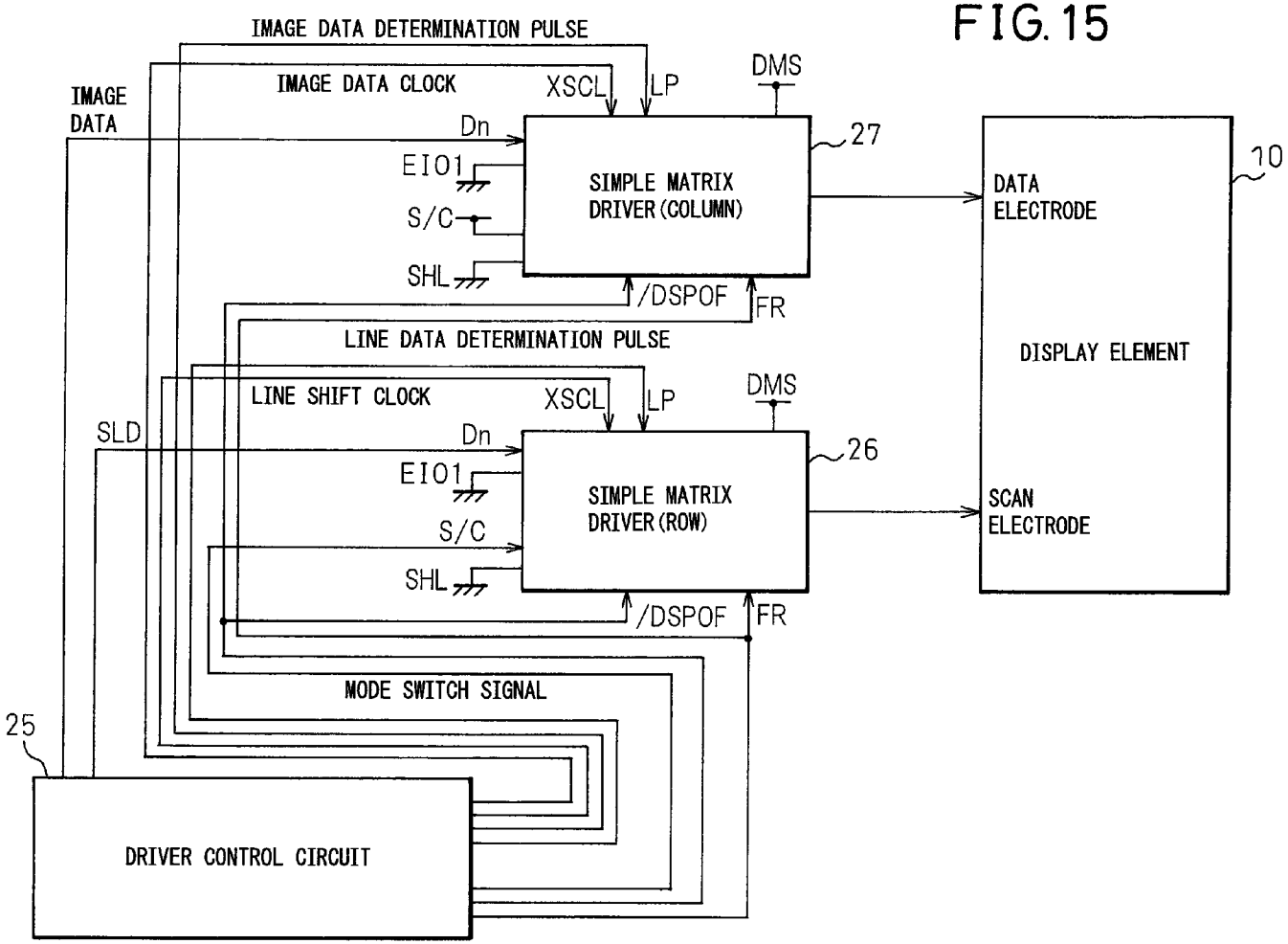
FIG. 15 is a diagram illustrating a general configuration of a color display device in a first embodiment.

FIG. 15 is a diagram illustrating a configuration of a display device in a first embodiment. FIG. 15 is a diagram corresponding to FIG. 11, including other elements as illustrated in FIG. 6, although not illustrated schematically here.

As illustrated in FIG. 15, the display device in the present embodiment has a driver control circuit 25, a row driver 26, a column driver 27, and the display element 10.

The display device 10 is in conformity with the A4 size/XGA specifications and has 1,024×768 pixels. The driver control circuit 25 generates a control signal based on a base clock from a clock source 24 and image data and supplies the control signal to the row driver 26 and the column driver 27.

The row driver 26 drives 768 scan lines and the column driver 27 drives 1,024 data lines. Because different image data is applied to each RGB pixel, the column driver 27 drives each data line independently. The row driver 26 drives the lines of RGB commonly. The row driver 26 and the column driver 27 are configured by the simple matrix driver capable of being switched between the segment mode and the common mode as illustrated in FIG. 9. The column driver 27 is used only in the segment mode, and therefore, a mode selection terminal S/C is connected to a HIGH voltage terminal as illustrated in FIG. 15. To the mode selection terminal S/C of the row driver 26, a mode switch signal from the driver control circuit 25 is input and it is possible to switch between the segment mode and the common mode.

To an XSCL terminal, an LP terminal, a /DSPOF terminal, an FR terminal, and a data input terminal Dn (D0-D7) of the column driver 27, an image data clock, an image determination pulse, an output invalidation signal /DSPOF, a pulse polarity control signal FR, and image data are input from the driver control circuit 25. The image data is illustrated to be output from the driver control circuit 25. However, it may also be possible for the image data to be input directly to the column driver 27 from a display data generation circuit not via the driver control circuit 25.

To the XSCL terminal, the LP terminal, the /DSPOF terminal, the FR terminal, the S/C terminal, and the data input terminal Dn (D0-D7) of the row driver 26, a line data clock, a line determination pulse, the output invalidation signal /DSPOF, the pulse polarity control signal FR, a mode switch signal, and selected line specification data SLD are input from the driver control circuit 25. The selected line specification data SLD is illustrated to be output from the driver control circuit 25. However, it may also be possible for the selected line specification data SLD to be input directly to the row driver 26 from the display data generation circuit not via the driver control circuit 25.

The other terminals of the driver are not related to the first embodiment directly, and therefore, their explanation is omitted.

Next, an image write operation in the first embodiment is explained.

Before the image write operation is performed, the voltage pulse of ±36 V having a pulse width of a few tens of ms or more illustrated FIG. 3A is applied to all of the pixels to bring the pixels into the planar state.

Figure 16:
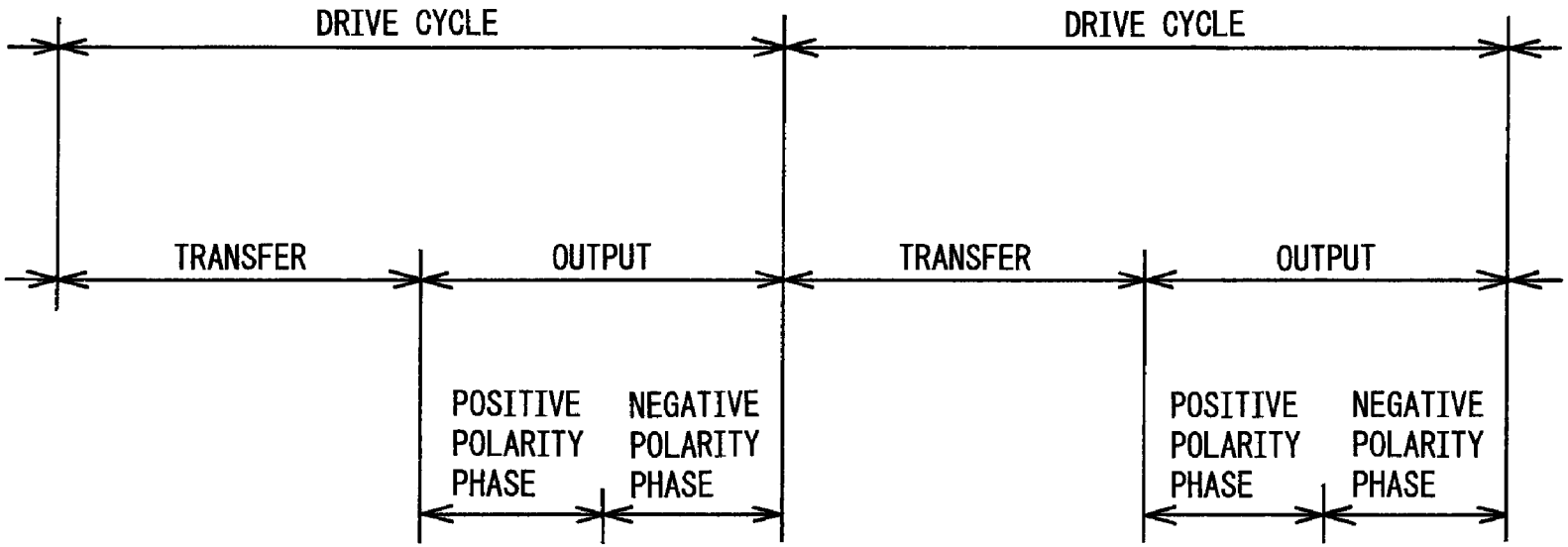
FIG. 16 is a diagram illustrating a gradation write operation of the display device in the first embodiment.

FIG. 16 is a diagram explaining a gradation write operation in the display device of the embodiment. In FIG. 16, one drive cycle is a period during which a scan pulse is applied to at least one or more scan lines (electrodes) and a gradation write pulse is applied to a pixel of the scan line to which the scan line has been applied, and thus, a gradation is written. When there are a plurality of scan lines to which a scan pulse is applied in one drive cycle, the plurality of lines have the same image data. As illustrated in FIG. 16, one drive cycle has two steps, that is, a step of transferring data and a step of outputting a voltage from the driver, and the output step further has a positive polarity phase and a negative polarity phase. In the positive polarity phase, a positive polarity gradation write pulse is output and in the negative polarity phase, a negative polarity gradation write pulse is output.

As illustrated in FIG. 7, in the conventional example, the transfer of data to the driver and the output of a voltage from the driver are performed in a parallel manner at least partially. However, in the present embodiment, the transfer of data to the driver and the output of a voltage from the driver are performed sequentially and not performed in a parallel manner.

Figure 17:
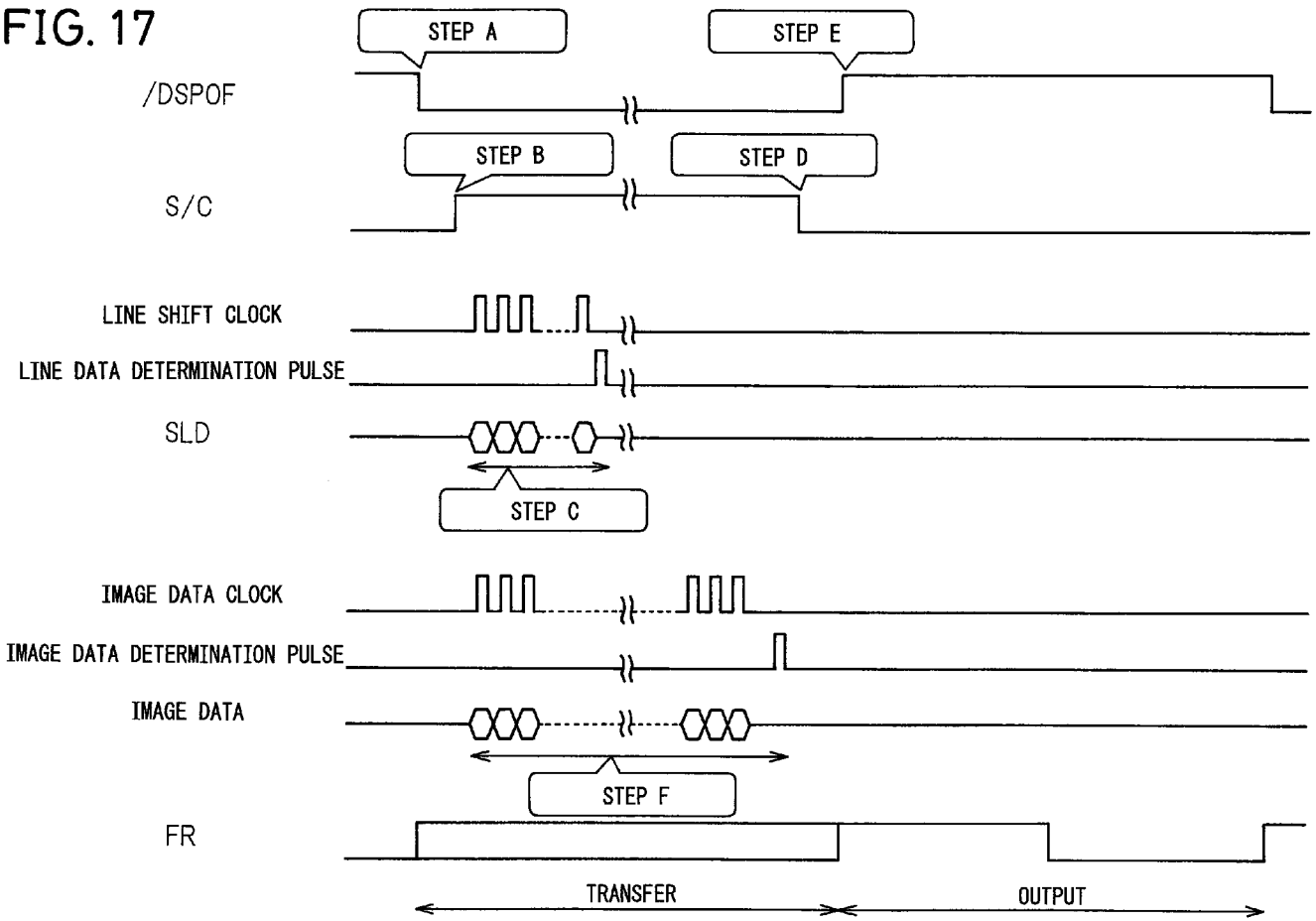
FIG. 17 is a time chart illustrating a drive sequence of the display device in the first embodiment.

FIG. 17 is a time chart illustrating an operation of one drive cycle in the present embodiment. A step of transferring data in one drive cycle has the following steps A to F.

In step A, the output invalidation signal /DSPOF is set to L (LOW: 0) so that the output of the row driver 26 and the column driver 27 is V5 (GND).

In step B, the mode switch signal is set to H (HIGH: 1) so that the row driver 26 is set to the segment mode.

In step C, the selected line specification data SLD is written to the row driver 26. This writing is performed by supplying the 8-bit selected line specification data SLD to the row driver 26 in synchronization with the line shift clock and by the row driver 26 storing the selected line specification data SLD to a data register in synchronization with the line shift clock.

In step D, the mode switch signal is set to 0 so that the row driver 26 is set to the common mode.

In step E, the output invalidation signal /DSPOF is set to 1 so that the output of the row driver 26 and the column driver 27 is validated and in response to this, a selected line is set in accordance with the selected line specification data SLD.

In step F, image data is written to the column driver 27. This writing is performed by supplying the image data to the column driver 27 in synchronization with the image data clock and by the column driver 27 storing the image data to the data register in synchronization with the image data clock.

As illustrated in FIG. 17, steps A to E are performed in this order; however, it is also possible to perform step F between step B and step D and to perform step C and step F in a parallel manner.

After step C and step F are completed, step D and step E are performed and thereby the output step is started. In the output step, the column driver 27 is in the segment mode and the row driver 26 is in the common mode, and therefore, if the same voltages V0, V21, and V34 as before are supplied in advance, a pulse having a voltage necessary to drive cholesteric liquid crystal can be output. In the positive polarity phase in the first half of the output step, the pulse polarity control signal FR is 1 and a positive polarity gradation write pulse is applied and in the negative polarity phase in the second half, the pulse polarity control signal FR is 0 and a negative polarity gradation write pulse is applied. The positive polarity gradation write pulse and the negative polarity gradation write pulse are symmetric and the gradation level is controlled by the pulse width. When the gradation level is controlled by the number of times of application of positive and negative gradation write pulses having a narrow pulse width, the pulse polarity control signal FR is varied to 1 and 0 in accordance with the period of the pulse.

A part where FR is 1 is set to a selected line in the selected line specification data SLD, and therefore, when there are a plurality of parts where FR is 1, a plurality of lines are selected. Further, the selected line specification data SLD can be set arbitrarily for each one drive cycle, and therefore, it is possible to arbitrarily set selected lines.

As explained above, in the first embodiment, while the output of the row driver 26 and the column driver 27 is invalidated between step A and step E, the mode switching in step B and step D is performed, and therefore, even if noises are generated resulting from the mode switching, the display of the display element is not affected.

Figure 18:
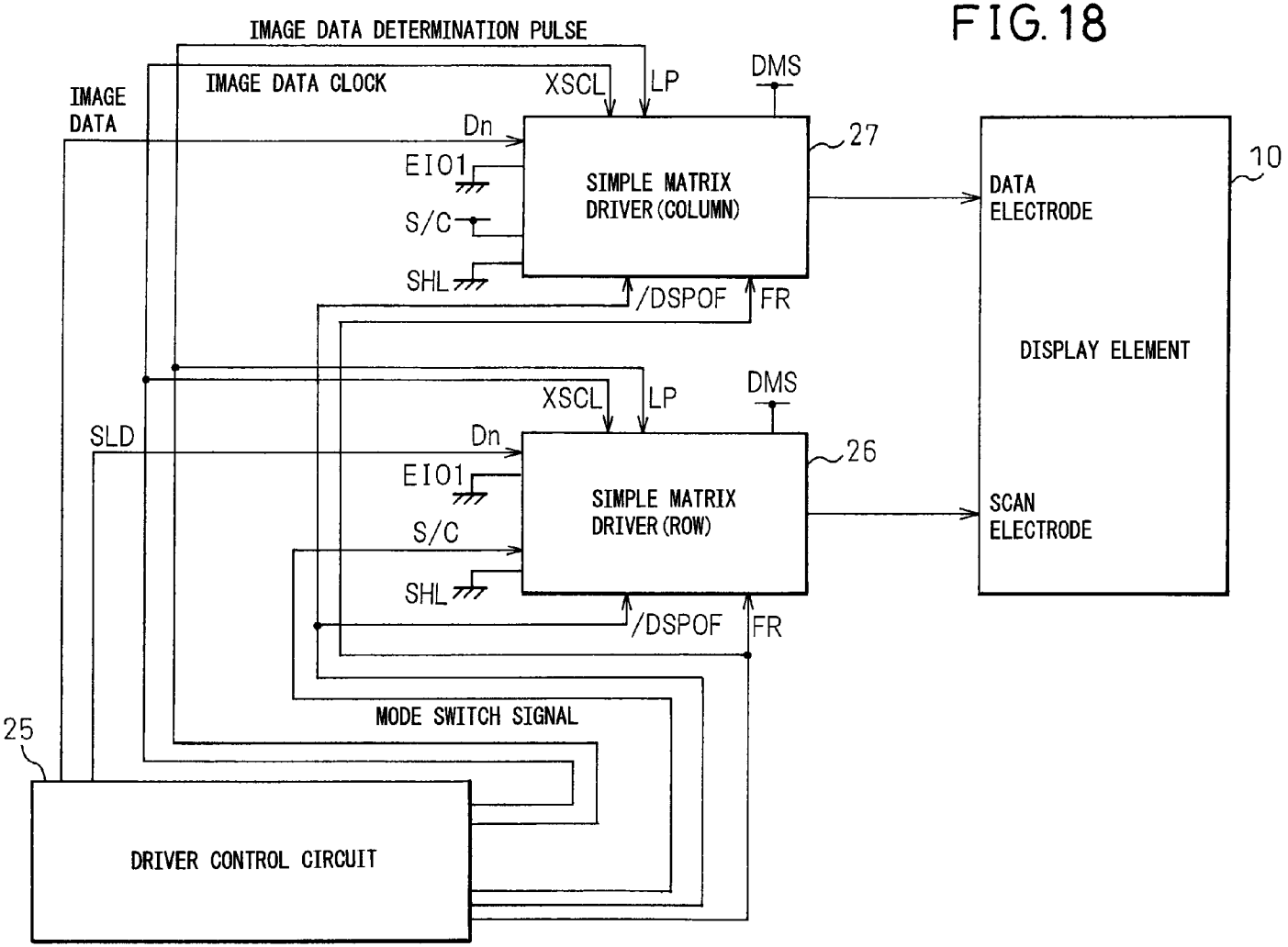
FIG. 18 is a diagram illustrating a general configuration of a color display device in a second embodiment.
Figure 19:
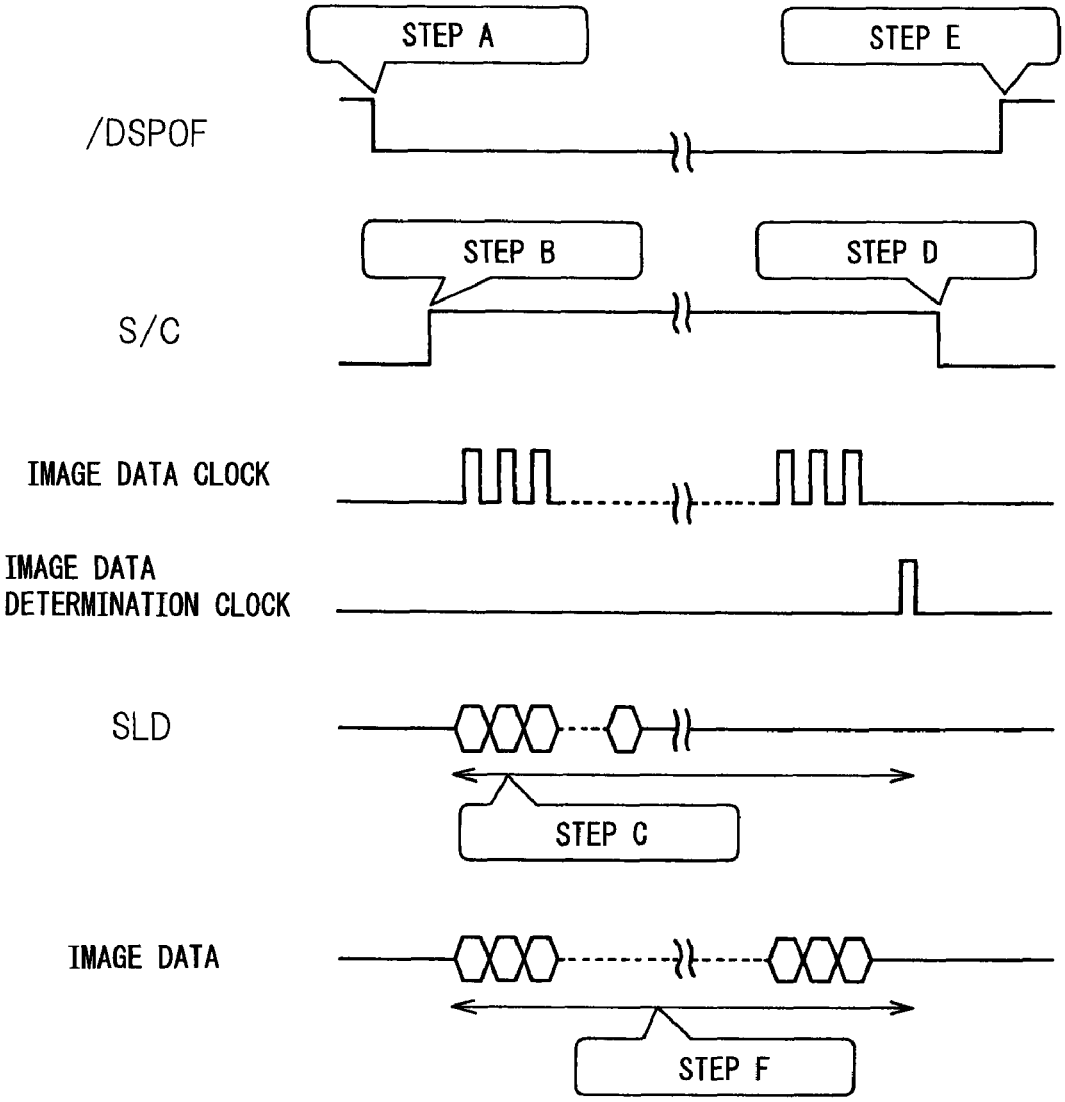
FIG. 19 is a time chart illustrating a drive sequence of the display device in the second embodiment.

FIG. 18 is a diagram illustrating a configuration of a display device in a second embodiment. FIG. 19 is a time chart illustrating an operation in one drive cycle of the display device in the second embodiment. In the second embodiment one drive cycle has a transfer step and an output step as illustrated in FIG. 16. In FIG. 19, only the transfer step is illustrated and the output step is not illustrated schematically.

The second embodiment differs from the first embodiment in that the image data clock is used instead of the line data clock and the image determination pulse is used instead of the line data determination pulse and the other parts are the same.

At the same timing at which step C is started, step F is started and before step D is started, the processing in step C and step F is completed at the same timing. In step C, the row driver 26 stores the 8-bit selected line specification data SLD in synchronization with the image data clock.

The display device in the second embodiment is manufactured in accordance with the specifications as below and its operation is confirmed.

The display element 10 is a cholesteric liquid crystal display element in conformity to the XGA specifications and has 1,024 data electrodes and 768 scan electrodes.

The simple matrix driver is the STN liquid crystal driver S1D17A03/S1D17A04 made by SEIKO EPSON CORPORATION described above.

The time interval between step A and step B is 2 μs, the time interval of start of step B, step C, and step F is 2 μs, the time interval from the writing of the final eight bits of the image data in step F to the application of the image data determination pulse is 6 μs, the time interval from the completion of step C and step F to step D is 2 μs, and the time interval from step D to step E is 2 μs.

Under the above-described condition, it has been confirmed that desired writing can be performed and noise is not generated in the display of the display element 10.

The normal operation can be achieved when the time interval between step A and step B is 1 μs or more, the time interval of start of step B, step C, and step F is 1 μs or more, the time interval from the completion of step C and step F to step D is 2 μs or more, and the time interval from step D to step E is 1 μs or more.

Some simple matrix drivers have no control signal that invalidates an output. A display device in a third embodiment to be explained next is an example where such a simple matrix driver is used.

Figure 20:
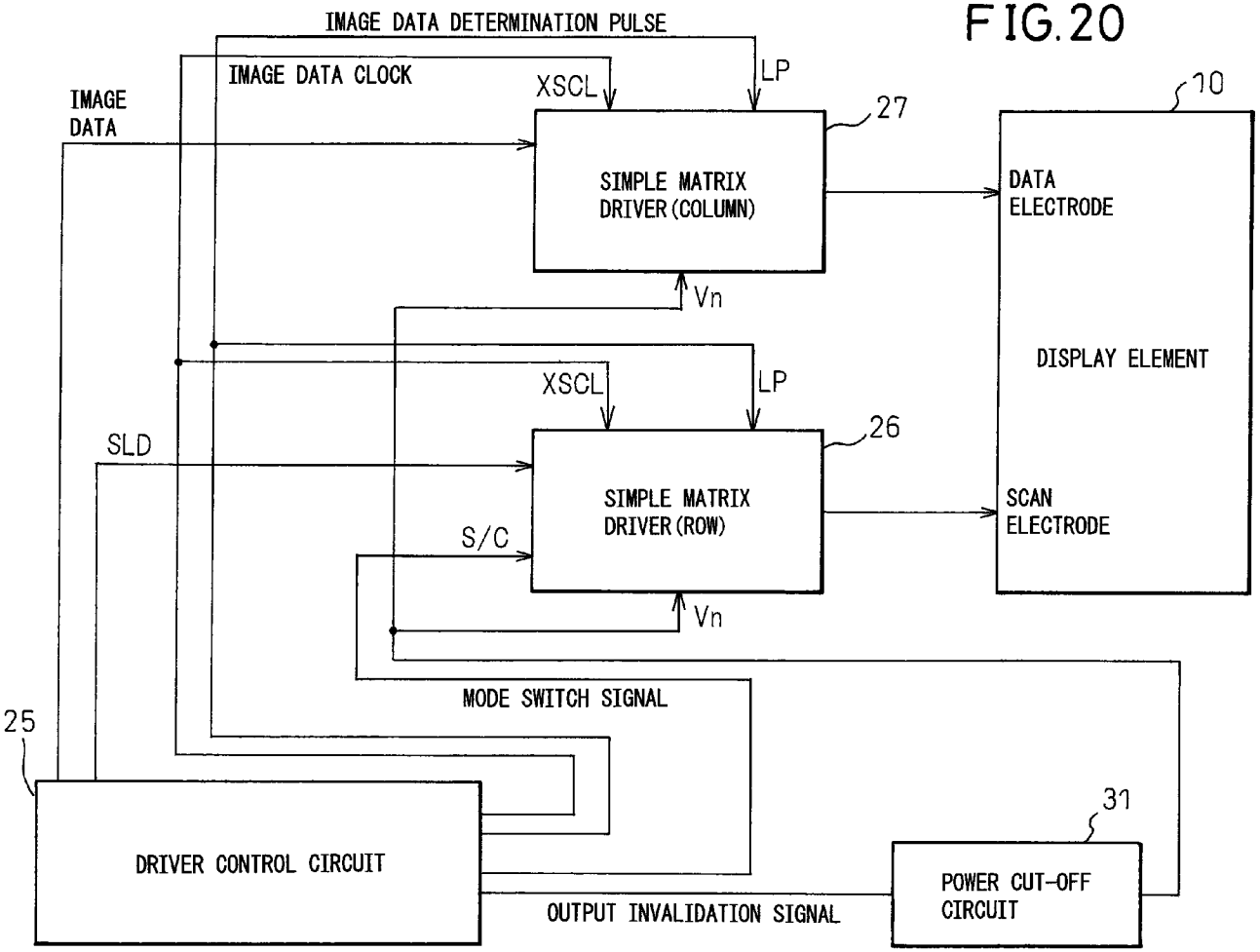
FIG. 20 is a diagram illustrating a general configuration of a color display device in a third embodiment.

FIG. 20 is a diagram illustrating a configuration of the display device in the third embodiment. Signals, such as the pulse polarity control signal FR, are not illustrated schematically. The drive sequence is the same as that in the second embodiment. In the third embodiment, as illustrated in FIG. 20, a power cut-off circuit 31 is provided, which sets the driver output power source (VDDH, V0, V21, V34, V5) of the two simple matrix drivers constituting the row driver 26 and the column driver 27 to the ground level (GND) in accordance with an output invalidation signal. The other configurations are the same as those in the second embodiment, and therefore, an explanation is omitted.

Figure 21:
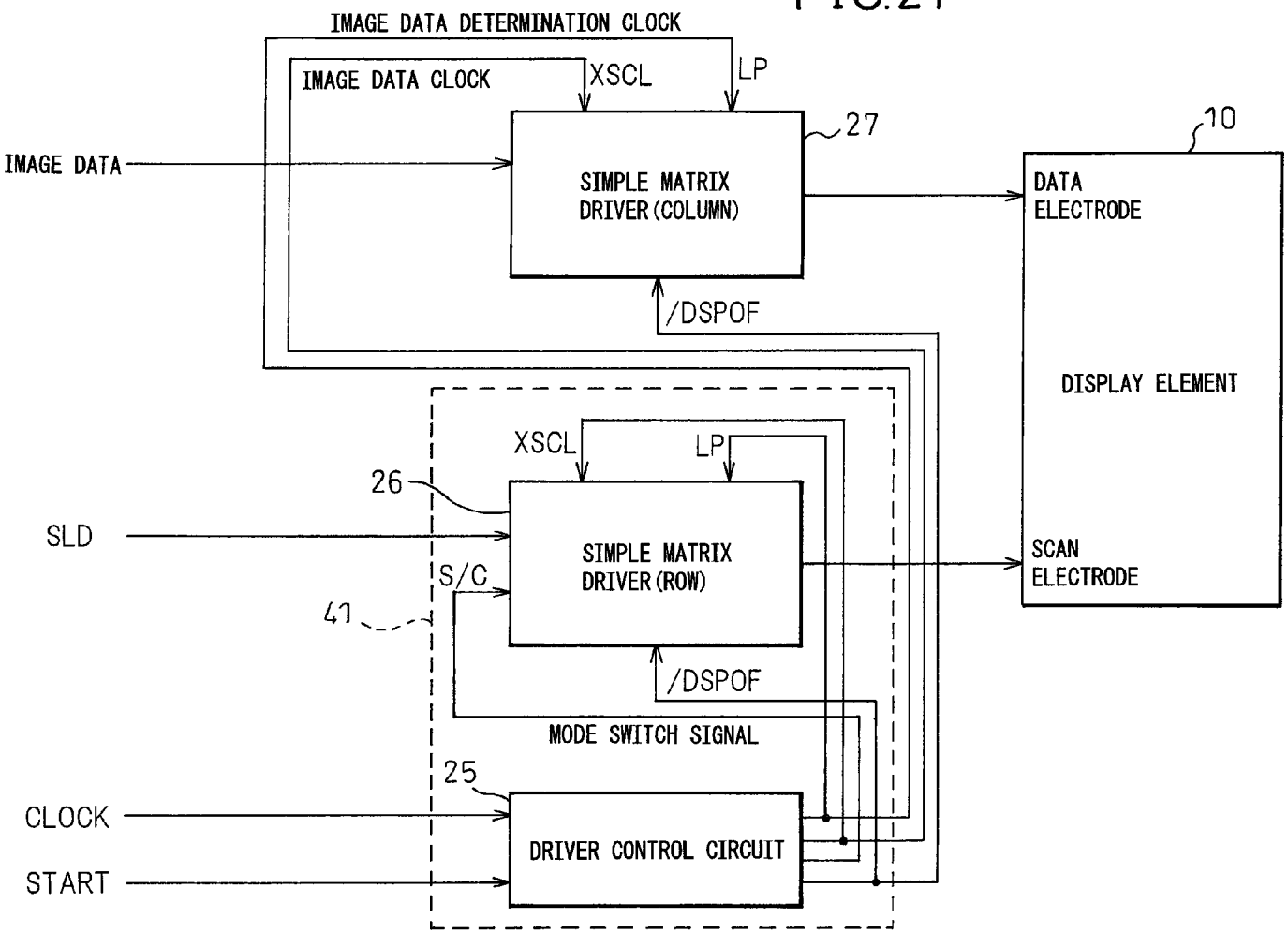
FIG. 21 is a diagram illustrating a general configuration of a color display device in a fourth embodiment.

In the first to third embodiments, the driver control circuit 25 is provided separately from the two simple matrix drivers constituting the row driver 26 and the column driver 27. However, it is also possible to incorporate the driver control circuit 25 in the simple matrix driver constituting the row driver 26 as illustrated in FIG. 21. Further, it is also possible to accommodate a bare chip of the simple matrix driver and a bare chip of the driver control circuit in one and the same package to form them into one chip.

Figure 22:
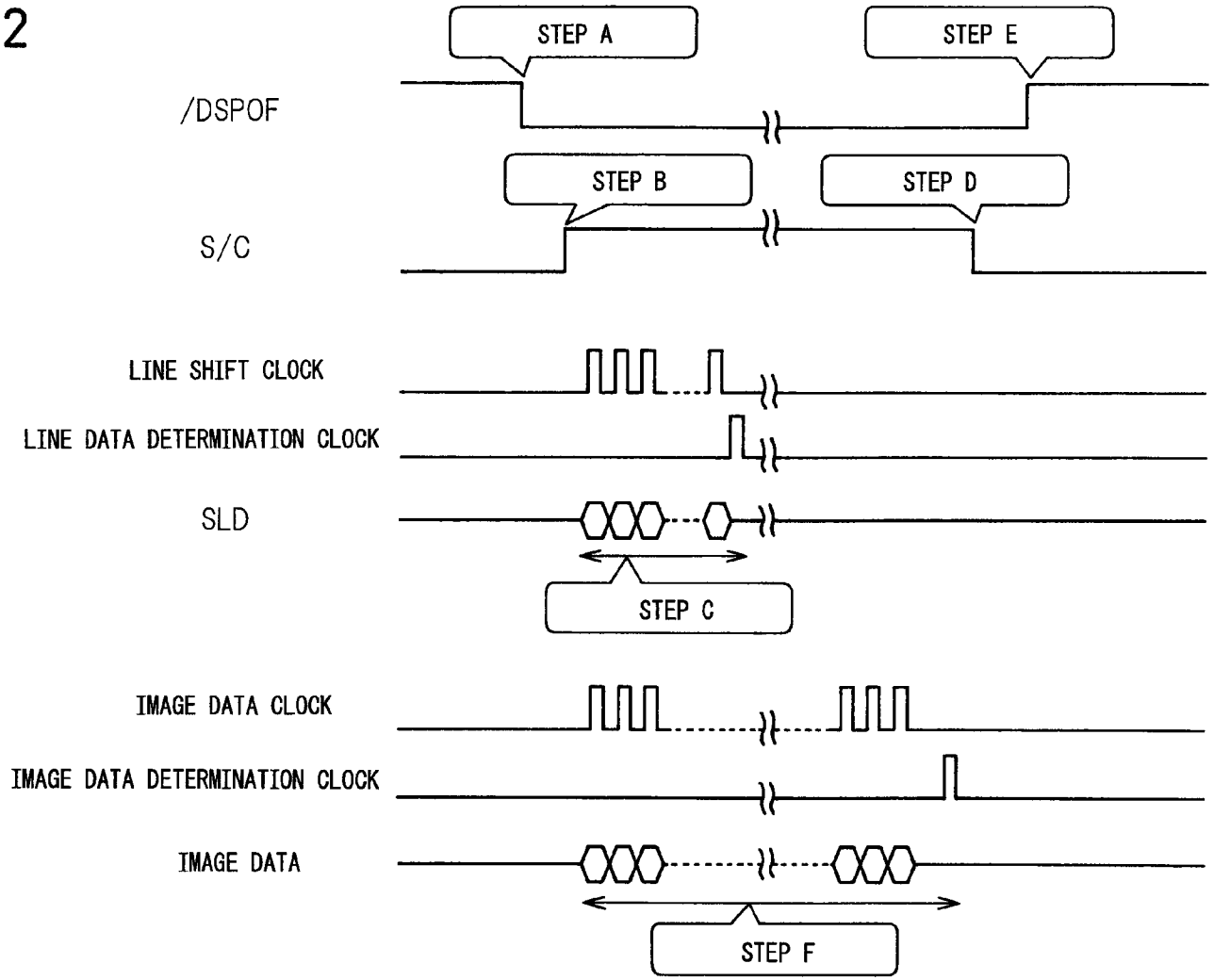
FIG. 22 is a time chart illustrating a drive sequence of the display device in the fourth embodiment.

FIG. 21 is a diagram illustrating a configuration of a display device in a fourth embodiment. In the fourth embodiment, in a package 41, the bare chip of the simple matrix driver constituting the row driver 26 and the bare chip of the driver control circuit 25 are accommodated. The other parts are the same as those in the second embodiment. To the driver control circuit 25, a clock CLOCK and a START signal that instructs to start one drive cycle are input and the driver control circuit 25 generates and outputs a control signal to perform the drive sequence as illustrated in FIG. 22 based on these signals. It is desirable for the clock CLOCK to have the same period as that of the image data clock.

In the fourth embodiment, when the START signal is input, step A and step B are performed automatically and the image data to be supplied to the column driver 27 from outside and the selected line specification data to be provided to the row driver 26 are stored successively in synchronization with the image data clock and when the number of pieces of the image data and the selected line specification data reaches a predetermined number, steps D and E are performed automatically.

As described above, according to the embodiments, when the simple matrix driver satisfies the restriction condition $V0 \geqq V21 \geqq V3 \geqq V5$, it is possible to simultaneously drive a plurality of lines using the simple matrix driver as a scanning driver (row driver) and to shorten the write time.

In the embodiments, a column driver is configured by a general-purpose simple matrix driver having a segment mode, a row driver is configured by a general-purpose simple matrix driver capable of being switched between a segment mode and a common mode, and display data is written to a display element by invalidating the output of the row driver and the common driver, setting the row driver to the segment mode, writing of selected line specification data to the row driver, writing image data to the common driver, and then, validating the output of the row driver and the common driver after setting the row driver to the common mode.

According to the embodiments, it is possible to randomly select lines to be written that are not successive without controlling the frequency of the line shift clock by using a general-purpose simple matrix driver capable of being switched between the segment mode and the common mode and the appropriately controlling the validation/invalidation of the output of the driver and the mode selection of the row driver.

It is possible to easily produce an output in accordance with the selected line specification data by supplying the selected lint specification data to the driver in the segment mode instead of image data. However, as described above, the general-purpose simple matrix driver has the restriction condition of voltage to be supplied and the general-purpose simple matrix driver set to the segment mode cannot satisfy the restriction condition of voltage of the common mode. Because of this, it is not possible to use the driver in the segment mode as a common driver as it is, in other words, as a row driver.

Because of the above, in the embodiments, the row driver is configured by a general-purpose simple matrix driver capable of being switched between the segment mode and the common mode, then the drive is set to the segment mode when selected line specification data is supplied and the common mode is set when the write of the selected line specification data is completed and then an output is produced.

Conventionally, when a general-purpose simple matrix driver capable of being switched between the segment mode and the common mode is used, a predetermined voltage is applied to a mode switch terminal and the driver is used in the segment mode or the common mode. However, the mode is not changed after the driver is incorporated in a device. This is because noises are generated when the modes of the driver are switched. In a display element that uses a display material having memory properties, such as cholesteric liquid crystal, the influence of noises on the display is great because of the memory properties. As illustrated in FIG. 7, an output is produced at the same times as image data is written to the drive, and if the modes are switched when driver produces an output, the noises resulting from the mode switching affect the display, deteriorating the quality of the display.

Because of the above, in the embodiments, the noises resulting in the mode switching are prevented from affecting the display by invalidating both the outputs of the column driver and the row driver while the row driver is set to the segment mode and the selected line specification data is written.

It has been found that it takes a certain period of time to validate/invalidate the output of the driver and for the noises resulting from the mode switching to become sufficiently small. Because of this, it is desirable for the time from the completion of the invalidation of the output of the row driver and the column driver until the operation to set the row driver to the segment mode is started to be 1 μs or more, for the time from the completion of the change of the row driver to the segment mode until the write of the selected line specification data to the row driver and the write of image data to the column driver are started to be 1 μs or more, for the time from the completion of the write of the selected line specification data to the row driver and the write of image data to the column driver until the change of the row driver to the common mode is started to be 2 μs or more, and for the time from the completion of the change of the row driver to the common mode until the validation of the output of the row driver and the column driver is started to be 1 μs or more.

Because it is necessary to provide the above-mentioned time to reduce the influence of noises, the write speed is reduced accordingly. Because of this, it is difficult to apply the constitutions of the embodiments to a normal STN liquid crystal display device that display a motion picture at present. However, for a cholesteric liquid crystal display device used as electronic paper, there arises no problem of reduction in write speed because the line drive period about 1,000 times longer than that of a normal STN liquid crystal device is acceptable.

The clock to write the selected line specification data to the row driver may be the same as the clock to write image data to the column driver.

The output of the row driver and the column driver is invalidated by applying a control signal to control the output voltage to a predetermined value or less of the general-purpose simple matrix driver in the segment mode and the general-purpose simple matrix driver capable of being switched between the segment mode and the common mode. The output of the row driver and the column driver can also be invalidated by setting the voltage to a predetermined value or less of the general-purpose simple matrix driver in the segment mode and the general-purpose simple matrix driver capable of being switched between the segment mode and the common mode.

The constitutions of the embodiments can be applied to any display device that uses a display material having memory properties. However, it is preferable in particular to apply the constitutions of the embodiments to a display device, such as electronic paper that uses liquid crystal that forms a cholesteric phase.

In a display device that uses liquid crystal that forms a cholesteric phase, the initial gradation state is the planar state and a gradation state other than the initial gradation state is a state where the planar state and the focal conic state coexist mixedly, and the value of a gradation is determined by the coexistence ratio. The display element is brought into the initial gradation state by applying an initialization voltage pulse to the pixel and then, brought into a gradation state other than the initial gradation state by applying a gradation voltage pulse to the initialized pixel, and the cumulative time during which the gradation pulse is applied is related to the value of the gradation state. It is possible for the display element to produce a color display by comprising a laminated structure in which a plurality of display elements that exhibit a plurality of different kinds of reflected light are laminated.

As a different aspect, it is also possible to realize a row driver capable of being switched between the segment mode and the common mode and which changes to the segment mode after invalidating the output when writing image data to a display element and changes into the common mode after reading the selected line specification data, and then validates the output. Given such a row driver provided, it is possible to easily realize a display device of the embodiments.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. A display device comprising:

a display element of matrix type;

a row driver that drives scan electrodes of the display element; and a column driver that drives data electrodes of the display element, wherein:

the column driver includes a matrix driver in a segment mode;

the row driver includes a matrix driver capable of being switched between the segment mode and a common mode; and writing of image data to the display element is performed by:

invalidating outputs of the row driver and the column driver;

setting the row driver to the segment mode; and validating the outputs of the row driver and the column driver after writing selected line specification data to the row driver and writing image data to the column driver, and then setting the row driver to the common mode, a time from completion of the invalidation of the outputs of the row driver and the column driver to a start of the operation to set the row driver to the segment mode is 1 μs or more, a time from completion of the change of the row driver to the segment mode to a start of the write of selected line specification data to the row driver and the write of image data to the column driver is 1 μs or more, a time from completion of the write of selected line specification data to the row driver and the write of image data to the column driver to a start of the change of the row driver to the common mode is 2 μs or more, and a time from completion of the change of the row driver to the common mode to a start of the validation of the outputs of the row driver and the column driver is 1 μs or more.

2. The display device according to claim 1, wherein a clock to write selected line specification data to the row drive is identical to a clock to write image data to the column driver.

3. The display device according to claim 1, wherein the invalidation of the outputs of the row driver and the column driver is performed by applying a control signal to set an output voltage to a predetermined value or less of the matrix driver in the segment mode and the matrix driver capable of being switched between the segment mode and the common mode.

4. The display device according to claim 1, wherein the invalidation of the outputs of the row driver and the column driver is performed by setting a voltage of driver output power source terminals of the matrix driver in the segment mode and the matrix driver capable of being switched between the segment mode and the common mode, to a predetermined value or less.

5. The display device according to claim 1, wherein the display element includes liquid crystal that forms a cholesteric phase.

6. The display device according to claim 5, wherein an initial gradation state is a planar state, a gradation state other than the initial gradation state is a state where the planar state and a focal conic state coexist mixedly, and a value of a halftone is determined by a coexistence ratio.

7. The display device according to claim 6, wherein:

the display element is brought into a gradation state other than the initial gradation state by applying a gradation voltage pulse to an initialized pixel after applying an initialization voltage pulse to the pixel to bring the pixel into the initial gradation state; and a cumulative time during which the gradation pulse is applied is related to the value of a gradation state.

8. The display device according to claim 1, wherein the display element comprises a laminated structure in which a plurality of display elements that exhibit a plurality of different kinds of reflected light are laminated.

9. A method of driving a display device, the display device comprising a display element of matrix type, a row driver that drives scan electrodes of the display element, and a column driver that drives data electrodes of the display element, wherein the column driver includes a matrix driver in a segment mode and the row driver includes a matrix driver capable of being switched between the segment mode and a common mode, wherein in the method, display data is written to the display element by:

invalidating outputs of the row driver and the column driver;

writing selected line specification data to the row driver and writing image data to the column driver in a state where the row driver is set to the segment mode;

setting the row driver to the common mode; and validating outputs of the row driver and the column mode, wherein a time from completion of the invalidation of the outputs of the row driver and the column driver to a start of the operation to set the row driver to the segment mode is 1 μs or more, a time from completion of the change of the row driver to the segment mode to a start of the write of selected line specification data to the row driver and the write of image data to the column driver is 1 μs or more, a time from completion of the write of selected line specification data to the row driver and the write of image data to the column driver to a start of the change of the row driver into the common mode is 2 μs of more, and a time from completion of the change of the row driver to the common mode to a start of the validation of the outputs of the row driver and the column driver is 1 μs or more.

10. The driving method according to claim 9, wherein a clock to write selected line specification data to the row drive is identical to a clock to write image data to the column driver.

11. The driving method according to claim 9, wherein the invalidation of the output of the row driver and the column driver is performed by applying a control signal to set an output voltage of the matrix driver in the segment mode and the matrix driver capable of being switched between the segment mode and the common mode to, a predetermined value or less.

12. The driving method according to claim 9, wherein the invalidation of the outputs of the row driver and the column driver is performed by setting a voltage of a driver output power source terminals of the matrix driver in the segment mode and the matrix driver capable of being switched between the segment mode and the common mode, to a predetermined value or less.

13. The driving method according to claim 9, wherein the display element includes liquid crystal that forms a cholesteric phase.

14. The driving method according to claim 13, wherein an initial gradation state is a planar state, a gradation state other than the initial gradation state is a state where the planar state and a focal conic state coexist mixedly, and a value of a halftone is determined by a coexistence ratio.

15. The driving method according to claim 14, wherein the display element is brought into a gradation state other than the initial gradation state by applying a gradation voltage pulse to an initialized pixel after applying an initialization voltage pulse to the pixel to bring the pixel into the initial gradation state; and a cumulative time during which the gradation pulse is applied is related to the value of a gradation state.

16. The driving method according to claim 9, wherein the display element comprises a laminated structure in which a plurality of display elements that exhibit a plurality of different kinds of reflected light are laminated.

* * * * *